US012680184B2

(12) United States Patent
Jonte et al.

(10) Patent No.: US 12,680,184 B2
(45) **Date of Patent: *Jul. 14, 2026**

(54) OZONE GENERATOR FOR A FAUCET

(71) Applicant: Delta Faucet Company, Indianapolis, IN (US)

(72) Inventors: Patrick B. Jonte, Zionsville, IN (US); Michael Scot Rosko, Greenwood, IN (US); Todd Andrew Huffington, Avon, IN (US); Kurt Judson Thomas, Indianapolis, IN (US); Derek Allen Brown, Lizton, IN (US)

(73) Assignee: Delta Faucet Company, Indianapolis, IN (US)

( * ) Notice: Subject to any disclaimer, the term of this patent is extended or adjusted under 35 U.S.C. 154(b) by 580 days.

This patent is subject to a terminal disclaimer.

(21) Appl. No.: 18/137,184

(22) Filed: Apr. 20, 2023

(65) Prior Publication Data

US 2023/0257894 A1 Aug. 17, 2023

Related U.S. Application Data

(63) Continuation of application No. 17/556,186, filed on Dec. 20, 2021, now Pat. No. 11,634,828, which is a (Continued)

(51) Int. Cl.

| | |
|---|---|
| ***C25B 9/00*** | (2021.01) |
| ***C25B 1/13*** | (2006.01) |
| ***C25B 9/19*** | (2021.01) |
| ***C25B 9/23*** | (2021.01) |
| ***C25B 11/03*** | (2021.01) |
| ***C25B 15/02*** | (2021.01) |
| ***C25B 15/08*** | (2006.01) |

(52) U.S. Cl.

CPC ..... *C25B 15/08* (2013.01); *C25B 1/13* (2013.01); *C25B 9/19* (2021.01); *C25B 9/23* (2021.01); *C25B 11/03* (2013.01); *C25B 15/02* (2013.01)

(58) Field of Classification Search

CPC .. C25B 15/08; C25B 9/23; C25B 9/19; C25B 1/13; C25B 11/03; C25B 15/02

See application file for complete search history.

(56) References Cited

U.S. PATENT DOCUMENTS

| | | | |
|---|---|---|---|
| 1,000,206 | A | 8/1911 | Spurge |
| 2,778,800 | A | 1/1957 | Sheahan |

(Continued)

FOREIGN PATENT DOCUMENTS

| | | |
|---|---|---|
| CA | 2682361 | 10/2008 |
| CN | 1565960 | 1/2005 |

(Continued)

OTHER PUBLICATIONS

Medi -Flo3 Sink, available at www.franke-commercial.com, available at least as early as Nov. 27, 2015, 1 page.

(Continued)

*Primary Examiner* — Zulmariam Mendez

(74) *Attorney, Agent, or Firm* — Bose McKinney & Evans LLP

(57) ABSTRACT

An electrolytic ozone generator for use with a faucet and methods for assembling and using the same.

23 Claims, 29 Drawing Sheets

Related U.S. Application Data continuation of application No. 16/866,029, filed on May 4, 2020, now Pat. No. 11,220,754, which is a continuation of application No. 15/336,048, filed on Oct. 27, 2016, now Pat. No. 10,640,878.

(60) Provisional application No. 62/254,667, filed on Nov. 12, 2015.

(56) References Cited

U.S. PATENT DOCUMENTS 3,653,514 A 4/1972 Holler et al.
3,805,481 A 4/1974 Armstrong
3,987,617 A 10/1976 Slob
4,214,962 A 7/1980 Pinchon
4,352,740 A 10/1982 Grader et al.
4,599,166 A 7/1986 Gesslauer
4,650,573 A 3/1987 Nathanson
4,955,535 A 9/1990 Tsutsui et al.
4,971,687 A 11/1990 Anderson
5,103,856 A 4/1992 Fleischmann
5,173,178 A 12/1992 Kawashima et al.
5,199,639 A 4/1993 Kobayashi et al.
5,205,994 A 4/1993 Sawamoto et al.
5,354,541 A 10/1994 Sali et al.
5,368,815 A 11/1994 Kasting et al.
5,405,631 A 4/1995 Rosenthal
5,460,705 A 10/1995 Murphy et al.
5,503,890 A 4/1996 Jung
5,566,702 A 10/1996 Philipp
5,578,280 A 11/1996 Kazi et al.
5,635,059 A 6/1997 Johnson
5,670,094 A 9/1997 Sasaki et al.
5,680,658 A 10/1997 Ho
5,728,287 A 3/1998 Hough et al.
5,766,462 A 6/1998 Jones
5,793,653 A 8/1998 Segal
5,803,139 A 9/1998 Kennedy
5,807,473 A 9/1998 Sadler et al.
5,824,274 A 10/1998 Long
5,843,291 A 12/1998 Eki et al.
5,843,307 A 12/1998 Faivre et al.
5,853,562 A 12/1998 Eki et al.
5,858,201 A 1/1999 Otsuka et al.
5,858,215 A 1/1999 Burchard et al.
5,858,435 A 1/1999 Gallo
5,868,311 A 2/1999 Cretu-Petra
5,871,701 A 2/1999 Long
5,900,143 A 5/1999 Dalton et al.
5,911,870 A 6/1999 Hough
5,932,171 A 8/1999 Malchesky
5,939,030 A 8/1999 Moxley et al.
5,945,068 A 8/1999 Ferone
5,948,374 A 9/1999 Kuzumoto et al.
5,961,920 A 10/1999 Soeremark
5,979,500 A 11/1999 Jahrling et al.
5,985,108 A 11/1999 Arai
5,989,407 A 11/1999 Andrews et al.
5,992,431 A 11/1999 Weber et al.
6,019,950 A 2/2000 Lai
6,024,882 A 2/2000 McNeilly et al.
6,030,586 A 2/2000 Kuan
6,039,884 A 3/2000 Burris et al.
6,086,833 A 7/2000 Conners et al.
6,110,292 A 8/2000 Jewett et al.
6,132,629 A 10/2000 Boley
6,135,146 A 10/2000 Koganezawa et al.
6,153,151 A 11/2000 Moxley et al.
6,171,469 B1 1/2001 Hough et al.
6,217,833 B1 4/2001 Kolu
6,231,769 B1 5/2001 Pean et al.
6,236,953 B1 5/2001 Segal
6,245,229 B1 6/2001 Kool et al.
6,251,172 B1 6/2001 Conrad
6,319,390 B1 11/2001 Kono et al.
6,328,044 B1 12/2001 Crisinel et al.
6,357,727 B1 3/2002 Cho
6,365,026 B1 4/2002 Andrews et al.
6,368,503 B1 4/2002 Williamson et al.
6,375,038 B1 4/2002 Daansen et al.
6,391,191 B2 5/2002 Conrad
6,392,546 B1 5/2002 Smith
6,419,831 B2 7/2002 Wang
6,428,710 B1 8/2002 Kempen et al.
6,431,189 B1 8/2002 Deibert
6,455,017 B1 9/2002 Kasting et al.
6,458,257 B1 10/2002 Andrews et al.
6,461,487 B1 10/2002 Andrews et al.
6,482,370 B2 11/2002 Holsclaw et al.
6,491,879 B2 12/2002 Conrad
6,506,309 B1 1/2003 Daniels et al.
6,521,194 B2 2/2003 Yeh
6,523,193 B2 2/2003 Saraya
6,551,490 B2 4/2003 Andrews et al.
6,576,096 B1 6/2003 Andrews et al.
6,581,215 B1 6/2003 Tai
6,585,867 B1 7/2003 Asano
6,595,440 B2 7/2003 Moriarty et al.
6,638,364 B2 10/2003 Harkins et al.
6,645,874 B1 11/2003 Torek et al.
6,652,816 B2 11/2003 Hwang
6,673,248 B2 1/2004 Chowdhury
6,712,951 B2 3/2004 Andrews et al.
6,723,233 B1 4/2004 Barnes
6,727,818 B1 4/2004 Wildman et al.
6,738,996 B1 5/2004 Malek et al.
6,746,580 B2 6/2004 Andrews et al.
6,757,921 B2 7/2004 Esche
6,797,156 B2 9/2004 Chau
6,800,206 B2 10/2004 Robinson
6,808,637 B2 10/2004 Cho
6,814,876 B1 11/2004 Neal
6,821,443 B2 11/2004 Kim
6,860,976 B2 3/2005 Andrews et al.
6,866,806 B2 3/2005 Andrews et al.
6,874,535 B2 4/2005 Parsons et al.
6,882,278 B2 4/2005 Winings et al.
6,964,739 B2 11/2005 Boyd et al.
6,970,574 B1 11/2005 Johnson
6,982,006 B1 1/2006 Boyers et al.
6,984,295 B2 1/2006 Shiue et al.
7,008,523 B2 3/2006 Herrington
7,008,592 B2 3/2006 Sias et al.
7,022,225 B1 4/2006 Clawson et al.
7,029,637 B2 4/2006 Hogarth et al.
7,070,125 B2 7/2006 Williams et al.
7,086,407 B2 8/2006 Lynn
7,087,123 B2 8/2006 Lynn
7,087,124 B2 8/2006 Lynn
7,135,108 B1 11/2006 Barnes
7,150,293 B2 12/2006 Jonte
7,188,632 B2 3/2007 Lynn
7,238,278 B2 7/2007 Coffey et al.
7,244,354 B2 7/2007 Burris et al.
7,275,551 B2 10/2007 Kanaya et al.
7,278,434 B2 10/2007 Huang
7,314,600 B2 1/2008 Matsuzaki
7,322,535 B2 1/2008 Erdely
7,422,684 B1 9/2008 Davis et al.
7,449,090 B2 11/2008 Andrews et al.
7,464,418 B2 12/2008 Seggio et al.
7,488,419 B1 2/2009 Wang et al.
7,494,074 B2 2/2009 Benstead
7,524,466 B2 4/2009 Long
7,531,710 B2 5/2009 Carson et al.
7,537,023 B2 5/2009 Marty et al.
7,542,586 B2 6/2009 Johnson
7,566,387 B2 7/2009 Nam et al.
7,604,735 B1 10/2009 Barnes
7,605,704 B2 10/2009 Munro et al.
7,607,443 B2 10/2009 Barnhill et al.
7,631,372 B2 12/2009 Marty et al.
7,659,824 B2 2/2010 Prodanovich et al.
7,662,293 B2 2/2010 Brolin et al.

(56) References Cited

U.S. PATENT DOCUMENTS 7,682,464 B2 3/2010 Glenn et al.
7,690,395 B2 4/2010 Jonte et al.
7,708,958 B2 5/2010 Namespetra et al.
7,722,874 B2 5/2010 Noelle et al.
7,753,074 B2 7/2010 Rosko et al.
7,767,095 B2 8/2010 Phillips et al.
7,767,168 B2 8/2010 Namespetra et al.
7,768,146 B2 8/2010 Balzano
7,818,083 B2 10/2010 Glenn et al.
7,819,136 B1 10/2010 Eddy
7,850,098 B2 12/2010 Vogel et al.
7,875,173 B1 1/2011 Barnes
7,909,269 B2 3/2011 Erickson et al.
7,922,668 B2 4/2011 Rimdzius et al.
7,922,890 B2 4/2011 Sanchez et al.
7,931,813 B2 4/2011 Asokan et al.
7,932,618 B2 4/2011 Baarman et al.
7,956,480 B2 6/2011 Onodera et al.
7,956,481 B2 6/2011 Baarman et al.
7,967,800 B2 6/2011 Chewins
7,997,301 B2 8/2011 Marty et al.
8,007,666 B1 8/2011 Davis et al.
8,029,726 B2 10/2011 Resch et al.
8,085,155 B2 12/2011 Prodanovich et al.
8,099,802 B2 1/2012 Yamaguchi et al.
8,110,047 B2 2/2012 Glenn et al.
8,127,782 B2 3/2012 Jonte et al.
8,152,142 B2 4/2012 Hirakui
8,249,295 B2 8/2012 Johnson
8,276,603 B2 10/2012 Berklund et al.
8,294,585 B2 10/2012 Barnhill
8,343,341 B2 1/2013 Davis et al.
8,361,289 B2 1/2013 Whitehead et al.
8,377,229 B2 2/2013 Barnhill et al.
8,400,309 B2 3/2013 Glenn et al.
8,431,006 B2 4/2013 Arihara et al.
8,525,666 B2 9/2013 Melker et al.
8,528,579 B2 9/2013 Jonte et al.
8,545,695 B2 10/2013 Chen et al.
8,734,626 B2 5/2014 Arihara et al.
8,742,932 B2 6/2014 Casares
8,844,564 B2 9/2014 Jonte et al.
8,932,408 B2 1/2015 Sellmer
8,951,477 B2 2/2015 Russell et al.
8,980,079 B2 3/2015 Yost et al.
8,999,261 B2 4/2015 Benedetto
9,174,845 B2 11/2015 Lynn
9,303,394 B2 4/2016 Mock et al.
9,340,918 B2 5/2016 Lv et al.
10,640,878 B2 5/2020 Jonte et al.
10,767,270 B2 9/2020 Jonte et al.
2001/0040133 A1 11/2001 Wang
2002/0019709 A1 2/2002 Segal
2002/0040867 A1 4/2002 Conrad
2002/0048539 A1 4/2002 Mackay
2002/0060189 A1 5/2002 Conrad
2002/0071795 A1 6/2002 Jensen
2002/0130091 A1 9/2002 Ekberg et al.
2002/0134736 A1 9/2002 Burris et al.
2002/0146357 A1 10/2002 Yeh
2003/0080467 A1 5/2003 Andrews et al.
2003/0099584 A1 5/2003 Diang et al.
2003/0108460 A1 6/2003 Andreev et al.
2003/0226751 A1 12/2003 Kasten
2004/0065623 A1 4/2004 Lee
2004/0140269 A1 7/2004 Chang
2005/0000911 A1 1/2005 Thorpe
2005/0103722 A1 5/2005 Freydina et al.
2005/0199484 A1 9/2005 Olstowski
2005/0214182 A1 9/2005 Lu
2005/0279686 A1 12/2005 Hsu
2006/0021923 A1 2/2006 Lin et al.
2006/0051259 A1 3/2006 Chiu
2006/0053546 A1 3/2006 Gloodt
2006/0078661 A1 4/2006 Wang
2006/0108293 A1 5/2006 Brolin et al.
2006/0130907 A1 6/2006 Marty et al.
2006/0151803 A1 7/2006 Wesner et al.
2006/0163169 A1 7/2006 Eckhardt et al.
2006/0186215 A1 8/2006 Logan
2006/0193758 A1 8/2006 Nam et al.
2006/0266683 A1 11/2006 Sung
2007/0020212 A1 1/2007 Bernal et al.
2007/0028975 A1 2/2007 Herring et al.
2007/0108135 A1 5/2007 Davis
2007/0125230 A1 6/2007 Powell et al.
2007/0154364 A1 7/2007 Tseng et al.
2007/0157978 A1* 7/2007 Jonte ..... E03C 1/057 137/613
2007/0204925 A1 9/2007 Bolderheij et al.
2007/0235065 A1 10/2007 Lin
2007/0246564 A1 10/2007 Rodenbeck et al.
2008/0023411 A1 1/2008 Liou
2008/0035580 A1 2/2008 De Rijk
2008/0039176 A1 2/2008 Okada
2008/0067078 A1 3/2008 Kitaori et al.
2008/0105764 A1 5/2008 Jianglin et al.
2008/0156642 A1 7/2008 Fryda et al.
2008/0181832 A1 7/2008 Shiue et al.
2008/0202994 A1 8/2008 Hsu et al.
2008/0203195 A1 8/2008 Schmitt
2008/0237368 A1 10/2008 Hengsperger et al.
2008/0251373 A1 10/2008 Oke
2008/0267840 A1 10/2008 Yeh
2008/0271238 A1 11/2008 Reeder et al.
2009/0039032 A1 2/2009 Patera et al.
2009/0039176 A1 2/2009 Davidson et al.
2009/0113619 A1 5/2009 Tichenor et al.
2009/0114605 A1 5/2009 Salama et al.
2009/0202396 A1 8/2009 Long
2009/0266383 A1 10/2009 Wang
2009/0269240 A1 10/2009 Tanaka
2009/0271238 A1 10/2009 Himley et al.
2009/0273477 A1 11/2009 Barnhill
2009/0301865 A1 12/2009 Yoshida et al.
2010/0001418 A1 1/2010 Hirakui
2010/0006450 A1 1/2010 Whitehead et al.
2010/0018927 A1 1/2010 Poole
2010/0021598 A1 1/2010 Lynn
2010/0089765 A1 4/2010 Arihara et al.
2010/0100242 A1 4/2010 Frank
2010/0116369 A1 5/2010 Lautzenheiser et al.
2010/0119670 A1 5/2010 Mazzariello
2010/0139779 A1 6/2010 Lautzenheiser et al.
2010/0143201 A1 6/2010 Long et al.
2010/0170570 A1 7/2010 Rodenbeck et al.
2010/0192987 A1 8/2010 Steffen
2010/0193977 A1 8/2010 Yamamoto et al.
2010/0252415 A1 10/2010 Lynn
2010/0320082 A1 12/2010 Kato et al.
2011/0030823 A1 2/2011 Seal et al.
2011/0036761 A1 2/2011 Chen et al.
2011/0068060 A1 3/2011 Hatten
2011/0079519 A1 4/2011 Widler et al.
2011/0175351 A1 7/2011 Baarman et al.
2011/0253220 A1 10/2011 Sawaski et al.
2011/0256027 A1 10/2011 Chen et al.
2011/0316703 A1 12/2011 Butler et al.
2011/0320134 A1 12/2011 Butler et al.
2012/0138478 A1 6/2012 Yost et al.
2012/0167926 A1 7/2012 Nakamura
2012/0216828 A1 8/2012 Tanaka et al.
2012/0266983 A1 10/2012 Tsai et al.
2013/0136669 A1 5/2013 Feldain et al.
2013/0146516 A1 6/2013 Chen et al.
2013/0206654 A1 8/2013 Lutz et al.
2013/0269733 A1 10/2013 Chakrabortty et al.
2014/0000733 A1 1/2014 Jonte et al.
2014/0076724 A1 3/2014 Cheng et al.
2014/0251795 A1 9/2014 Chen et al.
2014/0255257 A1 9/2014 Pawlow
2014/0322096 A1 10/2014 Pelfrey et al.
2014/0352799 A1* 12/2014 Rosko ..... C02F 1/78 137/237

(56) References Cited

U.S. PATENT DOCUMENTS

| | | | |
|---|---|---|---|
| 2015/0059085 | A1 | 3/2015 | Seibt |
| 2015/0157754 | A1 | 6/2015 | Rutter et al. |
| 2015/0191381 | A1 | 7/2015 | Wang |
| 2015/0197432 | A1 | 7/2015 | Widler et al. |
| 2015/0308084 | A1 | 10/2015 | Thompson et al. |
| 2015/0376804 | A1 | 12/2015 | Gorokhovsky et al. |
| 2016/0220714 | A1 | 8/2016 | Weltmann et al. |
| 2017/0137953 | A1 | 5/2017 | Jonte et al. |
| 2018/0112317 | A1 | 4/2018 | Zeng et al. |
| 2018/0171491 | A1 | 6/2018 | Jonte et al. |
| 2019/0001006 | A1 | 1/2019 | Rodenbeck et al. |
| 2020/0263312 | A1 | 8/2020 | Jonte et al. |

FOREIGN PATENT DOCUMENTS

| | | |
|---|---|---|
| CN | 1675435 | 9/2005 |
| CN | 1809655 | 7/2006 |
| CN | 101137797 | 3/2008 |
| CN | 101448744 | 6/2009 |
| CN | 101509576 | 8/2009 |
| CN | 102671559 | 9/2012 |
| CN | 103328690 | 9/2013 |
| CN | 103874786 | 6/2014 |
| CN | 103987664 | 8/2014 |
| EP | 0544744 | 6/1993 |
| EP | 1149054 | 3/2003 |
| EP | 1841924 | 10/2007 |
| JP | 06-306666 | 11/1994 |
| JP | 7060265 | 3/1995 |
| JP | 07-290073 | 11/1995 |
| JP | 08-071566 | 3/1996 |
| JP | 08-108017 | 4/1996 |
| JP | 08-281281 | 10/1996 |
| JP | 09-075958 | 3/1997 |
| JP | 10-005148 | 1/1998 |
| JP | 10-219786 | 8/1998 |
| JP | 10-328274 | 12/1998 |
| JP | 11-009481 | 1/1999 |
| JP | 11-021960 | 1/1999 |
| JP | 11-036394 | 2/1999 |
| JP | 11-047773 | 2/1999 |
| JP | 11-047774 | 2/1999 |
| JP | 11-140929 | 5/1999 |
| JP | 11-157808 | 6/1999 |
| JP | 11-236692 | 8/1999 |
| JP | 11-247258 | 9/1999 |
| JP | 2000-197891 | 7/2000 |
| JP | 2000-317474 | 11/2000 |
| JP | 2001-040731 | 2/2001 |
| JP | 2001-070770 | 3/2001 |
| JP | 2001-205059 | 7/2001 |
| JP | 2001-276666 | 10/2001 |
| JP | 2002-052327 | 2/2002 |
| JP | 2002-126481 | 5/2002 |
| JP | 2002-331233 | 11/2002 |
| JP | 2003-135944 | 5/2003 |
| JP | 2003-247255 | 9/2003 |
| JP | 2003-320278 | 11/2003 |
| JP | 2004-084445 | 3/2004 |
| JP | 2004-324190 | 11/2004 |
| JP | 2005-021718 | 1/2005 |
| JP | 2005-124797 | 5/2005 |
| JP | 2005-131489 | 5/2005 |
| JP | 2005-169297 | 6/2005 |
| JP | 2006-136862 | 6/2006 |
| JP | 2007-111689 | 5/2007 |
| JP | 2007-236706 | 9/2007 |
| JP | 2008-000666 | 1/2008 |
| JP | 2008-018327 | 1/2008 |
| JP | 2008-086960 | 4/2008 |
| JP | 2008-229491 | 10/2008 |
| JP | 2009-189279 | 8/2009 |
| JP | 2009-209378 | 9/2009 |
| JP | 2010-090586 | 4/2010 |
| JP | 2010-150630 | 7/2010 |
| JP | 2011-004990 | 1/2011 |
| KR | 1996-0014038 | 10/1996 |
| KR | 10-2009-0027908 | 3/2009 |
| KR | 10-2009-0030783 | 3/2009 |
| KR | 10-2009-0086962 | 8/2009 |
| KR | 10-1023415 | 4/2011 |
| TW | 586920 | 5/2004 |
| TW | 200516060 | 5/2005 |
| TW | M270172 | 7/2005 |
| TW | M323278 | 12/2007 |
| TW | 201117887 | 6/2011 |
| TW | 201350624 | 12/2013 |
| WO | WO 90/12084 | 10/1990 |
| WO | WO 98/16473 | 4/1998 |
| WO | WO 99/12084 | 3/1999 |
| WO | WO 00/35813 | 6/2000 |
| WO | WO 01/33529 | 5/2001 |
| WO | WO 02/14226 | 2/2002 |
| WO | WO 02/21475 | 3/2002 |
| WO | WO 03/40032 | 5/2003 |
| WO | WO 03/68375 | 8/2003 |
| WO | WO 03/79278 | 9/2003 |
| WO | WO 03/33402 | 11/2003 |
| WO | WO 2004/033376 | 4/2004 |
| WO | WO 2005/054545 | 6/2005 |
| WO | WO 2006/076149 | 7/2006 |
| WO | WO 2006/096991 | 9/2006 |
| WO | WO 2008/044262 | 4/2008 |
| WO | WO 2009/028845 | 3/2009 |
| WO | WO 2010/011887 | 1/2010 |
| WO | WO 2010/099397 | 9/2010 |
| WO | WO 2010/104564 | 9/2010 |
| WO | WO 2011/144285 | 11/2011 |
| WO | WO 2012/075425 | 6/2012 |
| WO | WO 2013/045508 | 4/2013 |
| WO | WO 2013/086217 | 6/2013 |
| WO | WO 2014/113699 | 7/2014 |
| WO | WO 2016/112922 | 7/2016 |
| WO | WO 2017/011506 | 1/2017 |

OTHER PUBLICATIONS

Ozone Boy, www.cleanwatestore.com/OS001630-p-ozone-faucet.html; Jun. 11, 2012.

Ozone Generator, www.alibaba.com/product-gs/267935887/small_ozone_generator_water_sterilizer w.., Jun. 11, 2012.

* cited by examiner

OZONE GENERATOR FOR A FAUCET

CROSS-REFERENCE TO RELATED APPLICATIONS

The present application is a continuation of U.S. patent application Ser. No. 17/556,186, filed Dec. 20, 2021, which is a continuation of U.S. patent application Ser. No. 16/866,029, filed May 4, 2020, now U.S. Pat. No. 11,220,754, which is a continuation of U.S. patent application Ser. No. 15/336,048, filed Oct. 27, 2016, now U.S. Pat. No. 10,640,878, which claims priority to U.S. Provisional Patent Application Ser. No. 62/254,667, filed Nov. 12, 2015, the disclosures of which are expressly incorporated by reference herein.

FIELD OF THE DISCLOSURE

The present disclosure relates to an ozone generator. More particularly, the present disclosure relates to an electrolytic ozone generator for use with a faucet, and to methods for assembling and using the same.

BACKGROUND AND SUMMARY OF THE DISCLOSURE

An electrolytic ozone generator may be used to produce ozone in water. The ozone may perform a beneficial disinfecting function by destroying bacteria and pathogens in the water or surfaces it contacts. However, existing ozone generators are often difficult to assemble, repair, have limited life, and may suffer from low water flow or reduced dissolved ozone concentration The present disclosure provides an electrolytic ozone generator for use with a faucet and to methods for assembling and using the same.

According to an illustrative embodiment of the present disclosure, an ozone generator is provided for use with a faucet, the ozone generator including an outer cartridge and an electrolytic cell assembly received within the outer cartridge. The electrolytic cell assembly includes a first housing, an anode coupled to the first housing, a second housing, a cathode coupled to the second housing, a separator positioned between the anode and the cathode, and a holder that couples the first housing to the second housing independently of the outer cartridge.

According to another illustrative embodiment of the present disclosure, an ozone generator is provided for use with a faucet, the ozone generator including a first housing, a first current spreader overmolded by the first housing, an anode in electrical communication with the first current spreader, a second housing, a second current spreader overmolded by the second housing, a cathode in electrical communication with the second current spreader, and a separator between the anode and the cathode.

According to a further illustrative embodiment of the present disclosure, an ozone generator system for use with a faucet includes a mixing valve having a cold water inlet fluidly coupled to a cold water source, a hot water inlet fluidly coupled to a hot water source, and an outlet in selective fluid communication with the cold water inlet and the hot water inlet, and a valve body having a first valve receiving chamber, a second valve receiving chamber, and an ozone generator receiving chamber, and an outlet passageway. The ozone generator system further includes an ozone generator received within the ozone generator receiving chamber, a first electrically operable valve received within the first valve receiving chamber and configured to control water flow from the outlet of the mixing valve to the outlet passageway of the valve body, and a second electrically operably valve received within the second valve receiving chamber and configured to control water flow from the cold water source to the ozone generator.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION OF THE DRAWINGS

An exemplary ozone generator 100 of the present disclosure is shown in FIGS. 1-4. The illustrative ozone generator 100 has an inlet end 102, an outlet end 104, and a longitudinal axis L extending therebetween.

Figure 1:
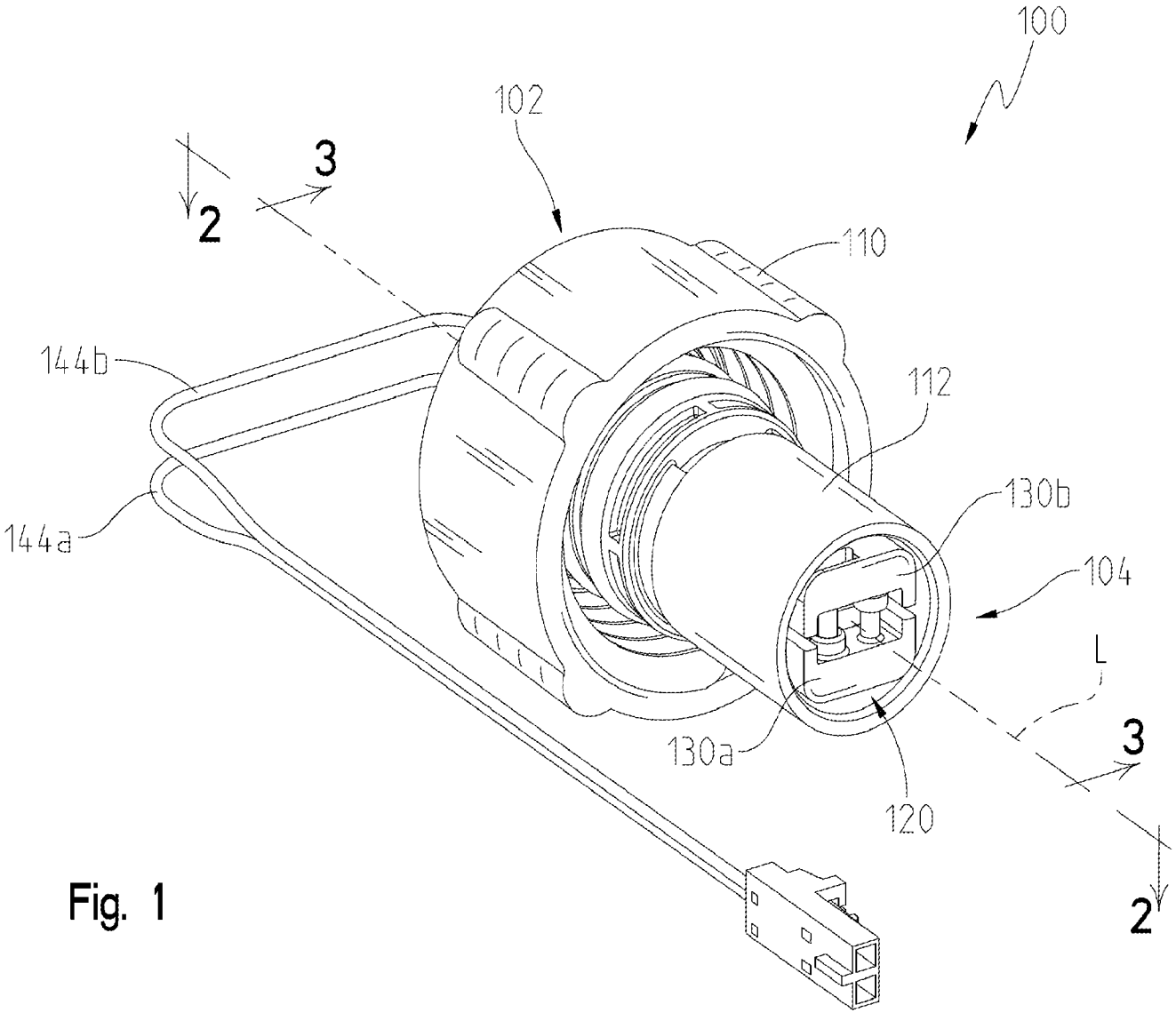
FIG. 1 is an assembled perspective view of an exemplary ozone generator of the present disclosure.
Figure 2:
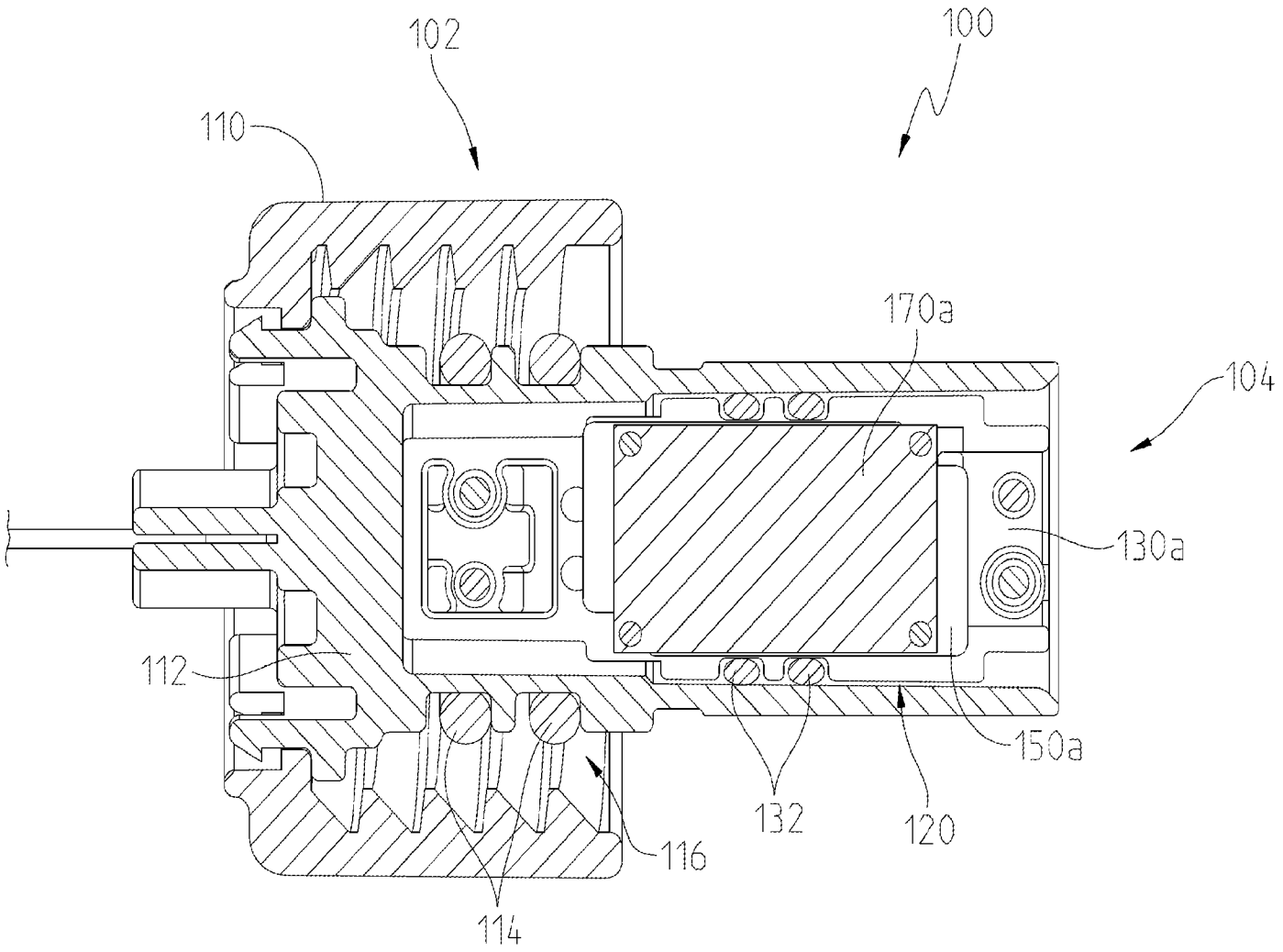
FIG. 2 is a cross-sectional view of the ozone generator of FIG. 1, taken along line 2-2 of FIG. 1.
Figure 3:
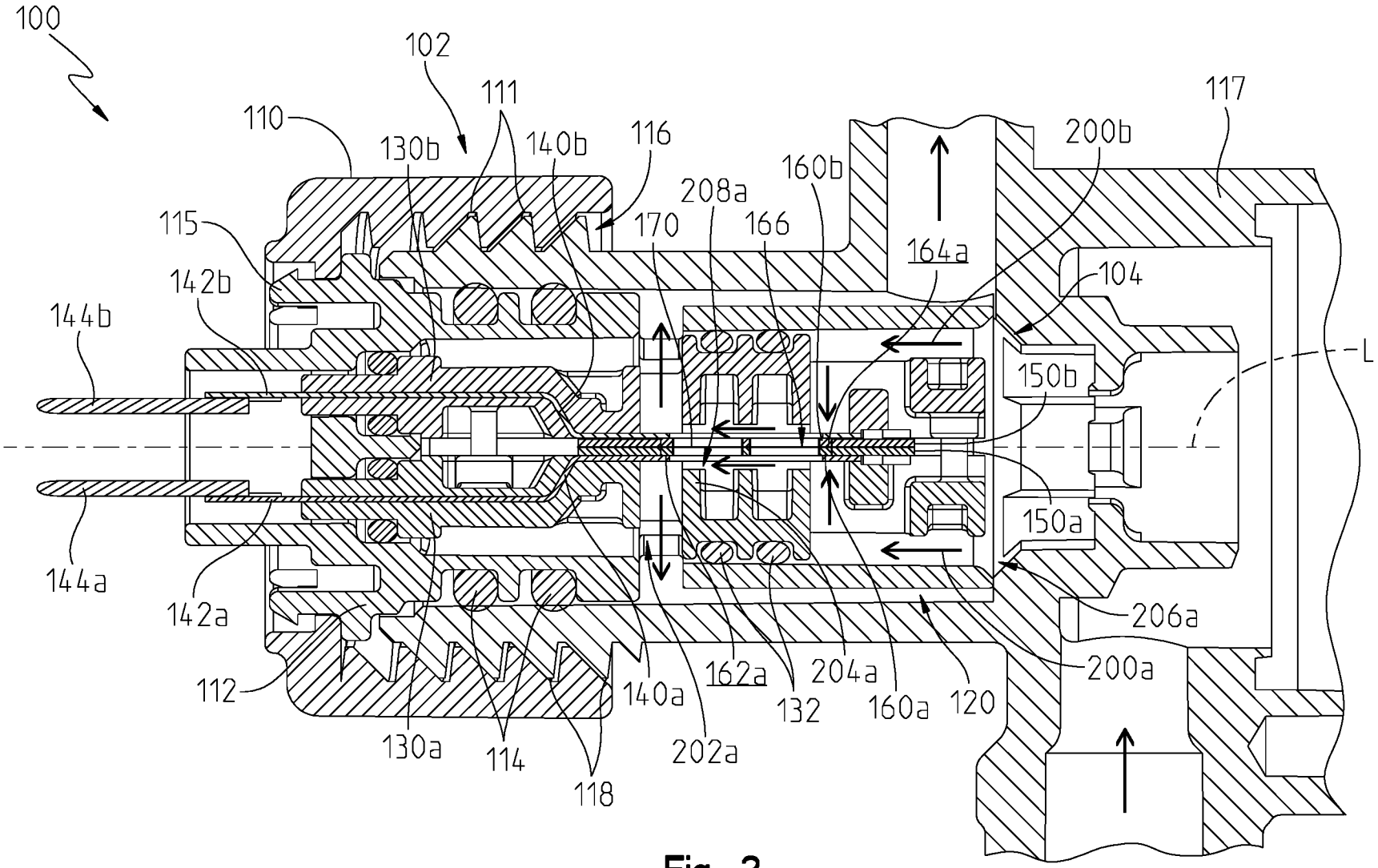
FIG. 3 is another cross-sectional view of the ozone generator of FIG. 1, taken along line 3-3 of FIG. 1, and showing the fluid pipe.
Figure 4:
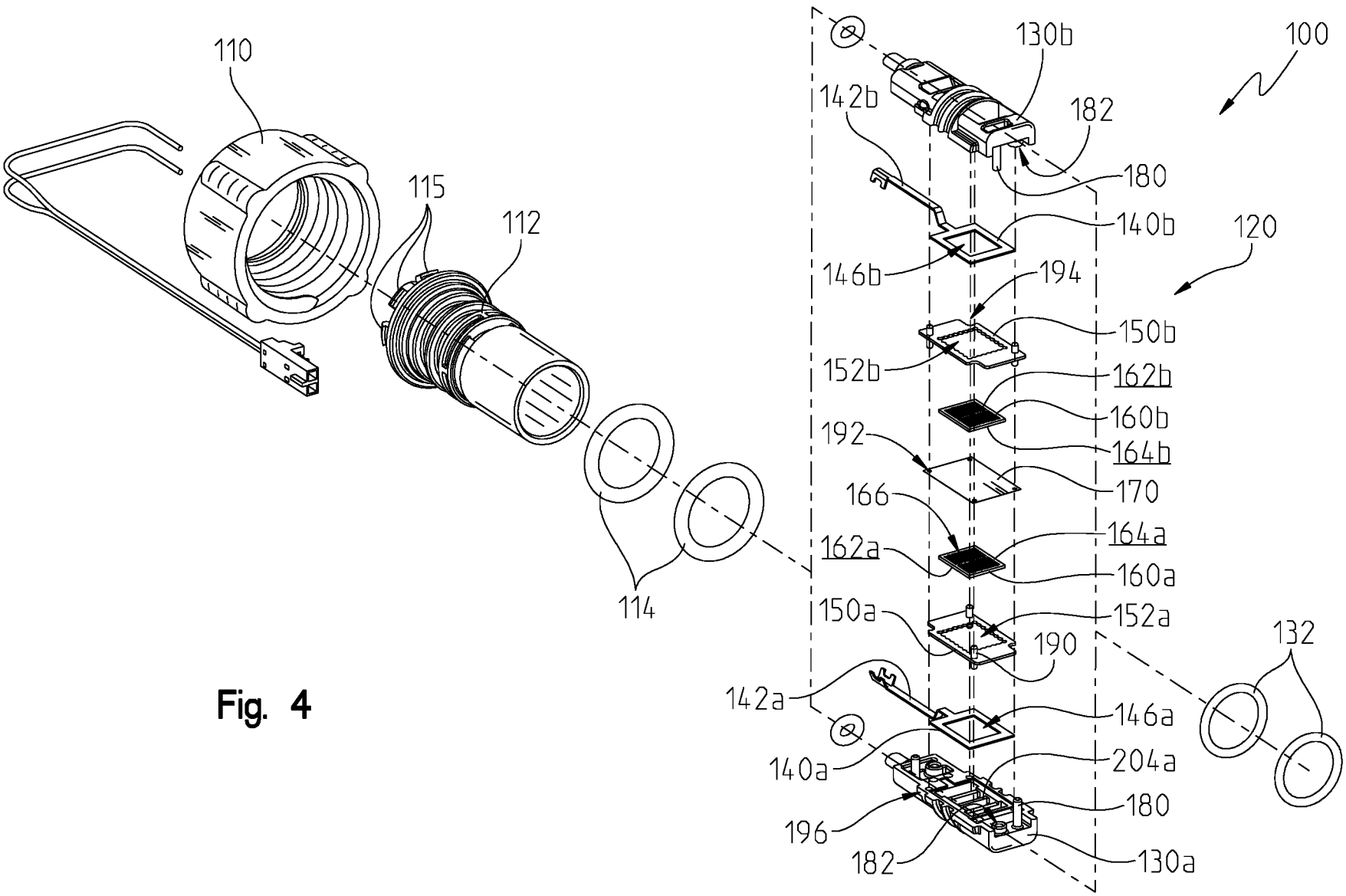
FIG. 4 is an exploded perspective view of the ozone generator of FIG. 1, the ozone generator including first and second housings, first and second current spreaders, first and second frames, first and second electrodes, and a separator.

As shown in FIGS. 1-3, the ozone generator 100 includes an outer pipe fitting 110, an outer cylindrical cartridge 112, and one or more outer sealing rings 114 surrounding the cartridge 112. The pipe fitting 110 and the cartridge 112 define a space 116 therebetween for receiving a fluid pipe 117 (FIG. 3). With reference to FIGS. 3 and 4, the illustrative cartridge 112 includes a plurality of circumferentially spaced arms 115 to snap fit to the pipe fitting 110. More particularly, the pipe fitting 110 is internally threaded to mate with externally threaded fluid pipe 117. As further shown in FIG. 3, internal threads 111 of the pipe fitting 110 engage with external threads 118 of the fluid pipe 117. The sealing rings 114, illustratively elastomeric o-rings, promote a sealed connection between the pipe fitting 110, the cartridge 112, and the fluid pipe 117.

As shown in FIG. 4, the ozone generator 100 further includes an electrolytic cell assembly 120 located inside the cartridge 112. The illustrative electrolytic cell assembly 120 includes a first housing or carrier 130*a* and a second housing or carrier 130*b*, a first current spreader 140*a* and a second current spreader 140*b*, a first frame 150*a* and a second frame 150*a*, a first electrode 160*a* and a second electrode 160*b*, and an electrolytic separator 170. Each component of the electrolytic cell assembly 120 is described further below with continued reference to FIG. 4.

The first and second housings 130*a*, 130*b* of the electrolytic cell assembly 120 are compressed together with the other components of the electrolytic cell assembly 120 being mechanically and electrically sandwiched therebetween. In FIG. 4, one or more sealing rings 132, illustratively elastomeric o-rings, are positioned around the housings 130*a*, 130*b* to hold the housings 130*a*, 130*b* together. Each housing 130*a*, 130*b* may be generally rectangular in cross-section except for the areas of rings 132, which may be generally semi-circular in cross-section. According to an exemplary embodiment of the present disclosure, the housings 130*a*, 130*b* are held together by the sealing rings 132 independently of the outer cartridge 112 to facilitate storage and assembly of the electrolytic cell assembly 112, with or without cartridge 112 in place. It is also within the scope of the present disclosure that the first and second housings 130*a*, 130*b* may be clamped, fastened, or otherwise held together. The housings 130*a*, 130*b* are constructed of an electrically insulating material, such as a polymer. An exemplary polymer is the Udel® P-1700 polysulfone material available from Solvay Plastics.

The first and second current spreaders 140*a*, 140*b* of the electrolytic cell assembly 120 mate with the first and second housings 130*a*, 130*b*, respectively. According to an exemplary embodiment of the present disclosure, the first and second housings 130*a*, 130*b* are overmolded onto the first and second current spreaders 140*a*, 140*b*, respectively, to form integral, pre-assembled, water-tight, hermetically-sealed components without the need for additional seals (e.g., epoxy). The current spreaders 140*a*, 140*b* are constructed of an electrically conductive material, such as titanium or another suitable material. The first current spreader 140*a* includes a first terminal 142*a* that extends out of the first housing 130*a* in a sealed manner for electrical communication with a first wire lead 144*a*. The first terminal 142*a* is illustratively planar and supports tabs 143*a* which are configured to be crimped onto the first wire lead 144*a*. Likewise, the second current spreader 140*b* includes a second terminal 142*b* that extends out of the second housing 130*b* in a sealed manner for electrical communication with a second wire lead 144*b*. The second terminal 142*b* is illustratively planar and supports tabs 143*b* which are configured to be crimped onto the second wire lead 144*b*.

The first current spreader 140*a* also includes a first rectangular body 145*a* defining a first opening 146*a* that is sized and shaped to receive and expose the first electrode 160*a*, as discussed further below. Likewise, the second current spreader 140*b* includes a second rectangular body 145*b* defining a second opening 146*b* that is sized and shaped to receive and expose the second electrode 160*b*, as discussed further below. The bodies 145*a* and 145*b* are illustratively planar wherein the openings 146*a*, 146*b* in the current spreaders 140*a*, 140*b* may be flush with the surrounding housings 130*a*, 130*b*. Between the first terminal 142*a* and the first opening 146*a*, the first current spreader 140*a* may be surrounded by the overmolded material of the first housing 130*a* in a sealed manner, as shown in FIG. 3. Likewise, between the second terminal 142*b* and the second opening 146*b*, the second current spreader 140*b* may be surrounded by the overmolded material of the second housing 130*b* in a sealed manner.

The first and second frames 150*a*, 150*b* of the electrolytic cell assembly 120 mate with the first and second housings 130*a*, 130*b*, respectively. The frames 150*a*, 150*b* are constructed of an electrically insulating material, such as a polymer. An exemplary polymer is the Udel® P-1700 polysulfone material available from Solvay Plastics. The first frame 150*a* includes a first scalloped opening 152*a* that is sized and shaped to receive the first electrode 160*a* in electrical communication with the first current spreader 140*a*. Likewise, the second frame 150*b* includes a second scalloped opening 152*b* that is sized and shaped to receive the second electrode 160*b* in electrical communication with the second current spreader 140*b*. The first and second frames 150*a*, 150*b* may cooperate with the first and second overmolded housings 130*a*, 130*b* to otherwise shield or insulate the first and second current spreaders 140*a*, 140*b*, respectively, to prevent electrical contact between the first and second current spreaders 140*a*, 140*b*.

The first and second electrodes 160*a*, 160*b* of the electrolytic cell assembly 120 are received within the first and second frames 150*a*, 150*b*, respectively. Each electrode 160*a*, 160*b* may have a back side 162*a*, 162*b* that interacts with the adjacent current spreader 140*a*, 140*b*, respectively, and a front side 164*a*, 164*b* that interacts with the separator 170. An exemplary electrode 160*a*, 160*b* is constructed of boron-doped silicon or another suitable material. The boron doped silicon material serves as a conductor to pass current between the current spreader and boron doped, The deposed silicon material may be about 200-800 microns thick, such as about 500 microns thick. The front side 164*a*, 164*b* of each electrode 160*a*, 160*b* may have a boron-doped diamond coating or another suitable coating. The coating may be about 2-10 microns thick. The coating may be applied to the underlying silicon material by chemical vapor deposition (CVD) or another suitable deposition technique. The illustrative electrodes 160*a*, 160*b* are generally rectangular in shape, having a width of about 8 millimeters and a length of about 10 millimeters, although the size and shape of the electrodes 160*a*, 160*b* may vary.

As discussed further below, the electrodes 160*a*, 160*b* communicate with the water flowing through the electrolytic cell assembly 120. Each electrode 160*a*, 160*b* may include a plurality of water passageways 166 (e.g., slots) to increase the exposed surface area of each electrode 160*a*, 160*b* for communication with water and to allow water flow through each electrode 160*a*, 160*b*. To allow for precise control of their size and shape, the water passageways 166 may be formed using deep reactive ion etching (DRIE) or another suitable technique.

Figure 5B:
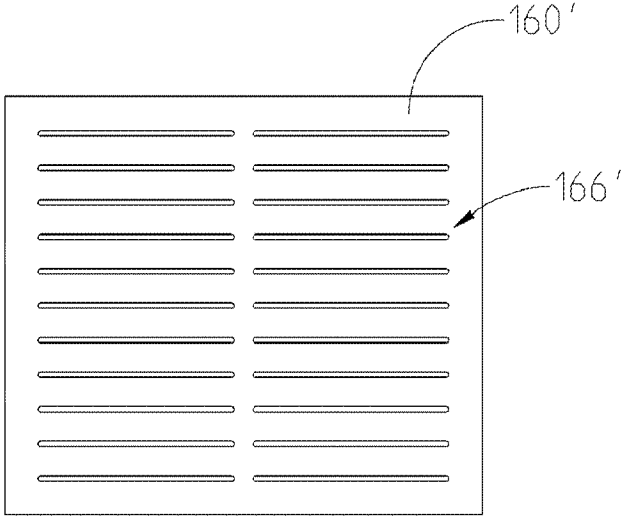
FIGS. 5A-5D are plan views of exemplary electrodes for use in the ozone generator of FIG. 1.
Figure 5D:
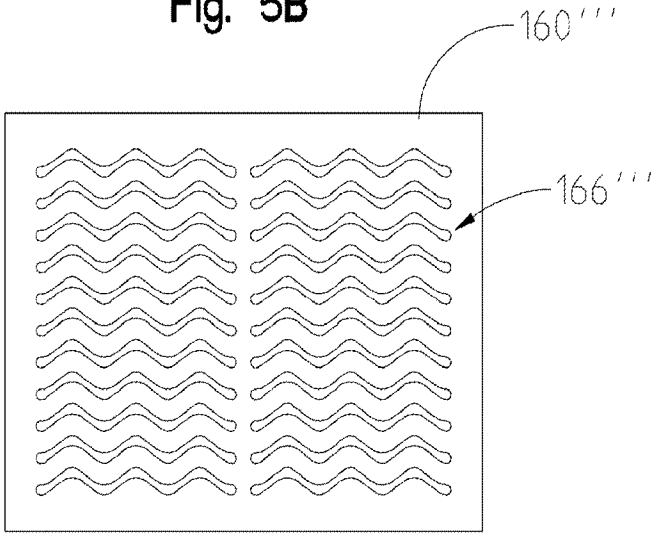
Figure 5A:
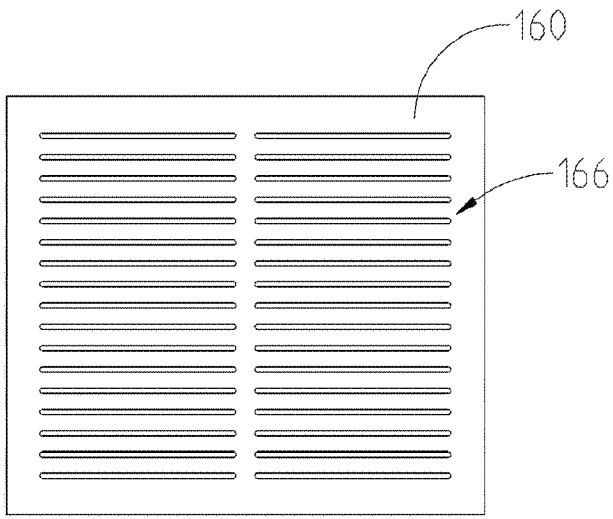
Figure 5C:
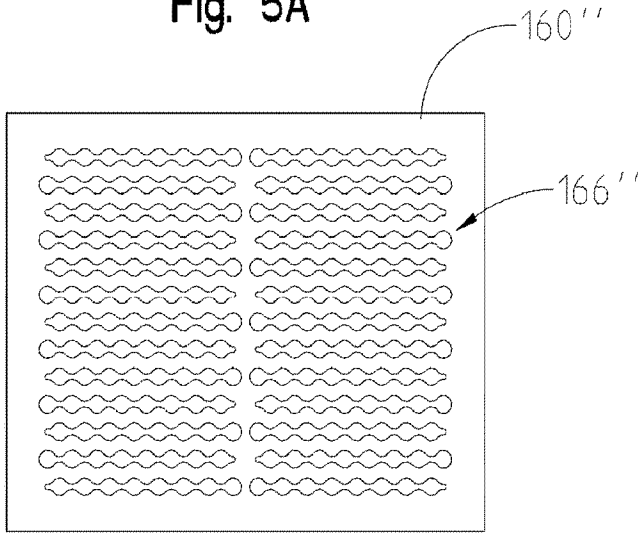
Figure 6:
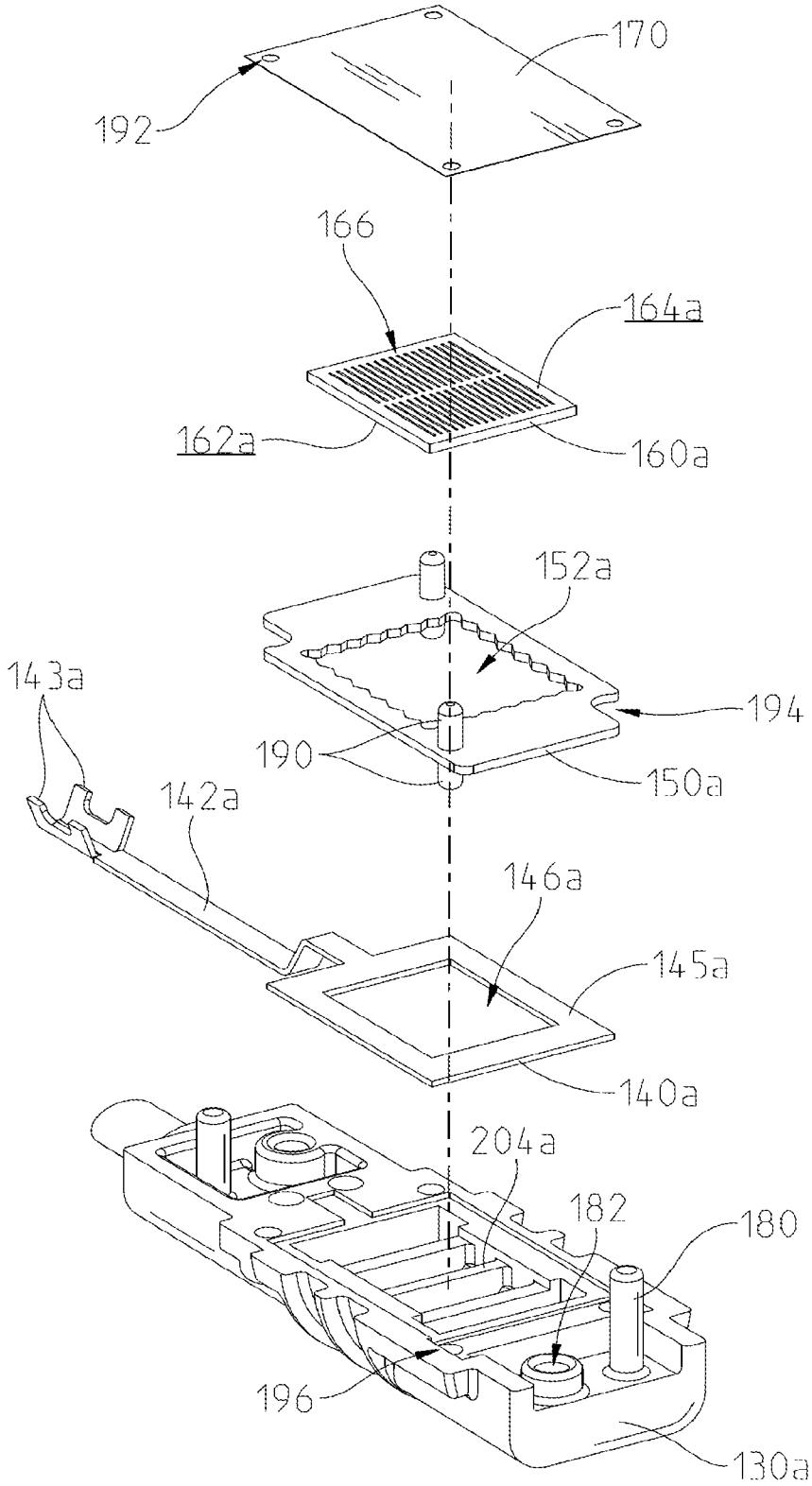
FIG. 6 is an exploded perspective view of the first housing, the first current spreader, the first frame, the first electrode, and the separator of FIG. 4.

Various electrodes 160-160''' having different configurations of water passageways 166-166''' are shown in FIGS. 5A-5D. In FIG. 5A, the electrode 160 includes a relatively large number of (specifically 34) straight water passageways 166. Electrode 160 may be referenced as having a "fine" design. In FIG. 5B, the electrode 160' includes a relatively small number of (specifically 22) straight water passageways 166'. Electrode 160' may be referenced as having a "sparse" design. In FIG. 5C, the electrode 160'' includes an intermediate number of (specifically 26) water passageways 166'' that vary in width repeatedly across their length from a widened bulbous shape to a narrowed straight shape. Electrode 160'' may be referenced as having a "knotted" design. In FIG. 5D, the electrode 160''' includes a relatively small number of (specifically 22) water passageways 166''' that deviate side-to-side in a zig-zag or wave-like pattern across their length. Electrode 160''' may be referenced as a "serpentine" design.

Additional details of illustrative electrodes 160 are provided in U.S. Provisional Patent Application Ser. No. 62/191,741, filed Jul. 13, 2015, entitled "Electrode for an Ozone Generator", the entire disclosure of which is expressly incorporated herein by reference.

The separator 170 of the electrolytic cell assembly 120 is positioned between the first and second electrodes 160*a*, 160*b*. The separator 170 is a proton exchange membrane (PEM) designed to conduct protons between the electrodes 160*a*, 160*b*. The separator 170 may be constructed of a solid polymer electrolyte (SPE) membrane. An exemplary SPE membrane is a polytetrafluoroethylene (PTFE)/perfluorosulfonic acid (PFSA) copolymer membrane, which is commercially available from DuPont™ as a Nafion® membrane. Because pressures on the separator 170 are balanced, the separator 170 may be a thin, cast film. The thin separator 170 may allow for some cross-diffusion of water, hydrogen, and/or oxygen without negatively impacting the performance of the electrolytic cell assembly 120. In fact, such diffusion may promote efficiency and output by reducing polarization voltage associated with dehydration and reducing bulk ion resistance. An exemplary separator 170 may be about 20-30 microns thick, such as about 25 microns thick.

Referring next to FIGS. 6-9, the components of the electrolytic cell assembly 120 may include registration features to facilitate the assembly process and, once assembled, to produce stable mechanical connections between the components. For example, the first housing 130*a* may include one or more posts 180 that register with corresponding holes 182 in the second housing 130*b*. As another example, the first frame 150*a* may include one or more posts 190 that register with corresponding holes 192 in the separator 170, corresponding notches 194 in the second frame 150*b*, and corresponding holes 196 in both housings 130*a*, 130*b* The outer perimeter of the electrodes 160*a*, 160*b* may be smaller than the area defined by the posts 190 in the frames 150*a*, 150*b* to avoid the need for forming corresponding registration holes in the electrodes 160*a*, 160*b*, which could risk damage to the fragile electrodes 160*a*, 160*b* and reduce the active area of the electrodes 160*a*, 160*b*.

Figure 7:
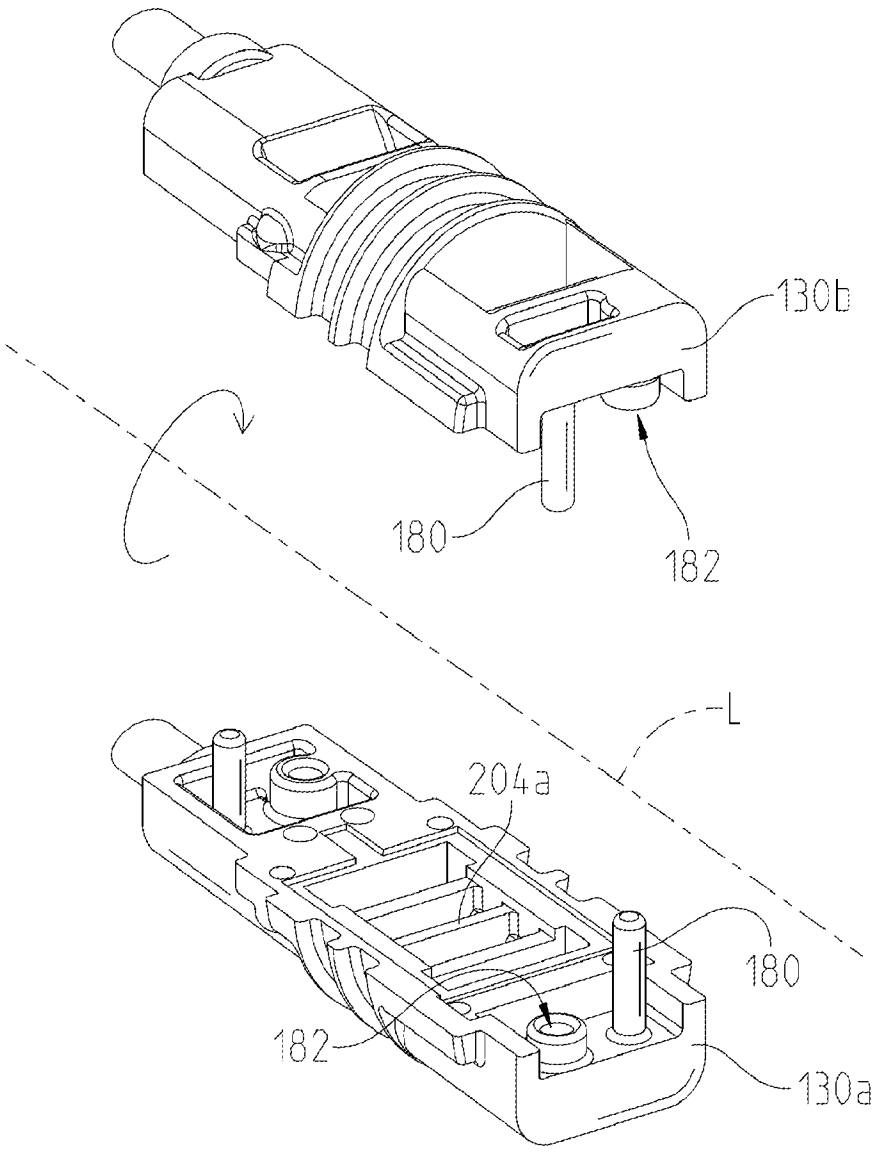
FIG. 7 is a perspective view of the first and second housings of FIG. 4.
Figure 8:
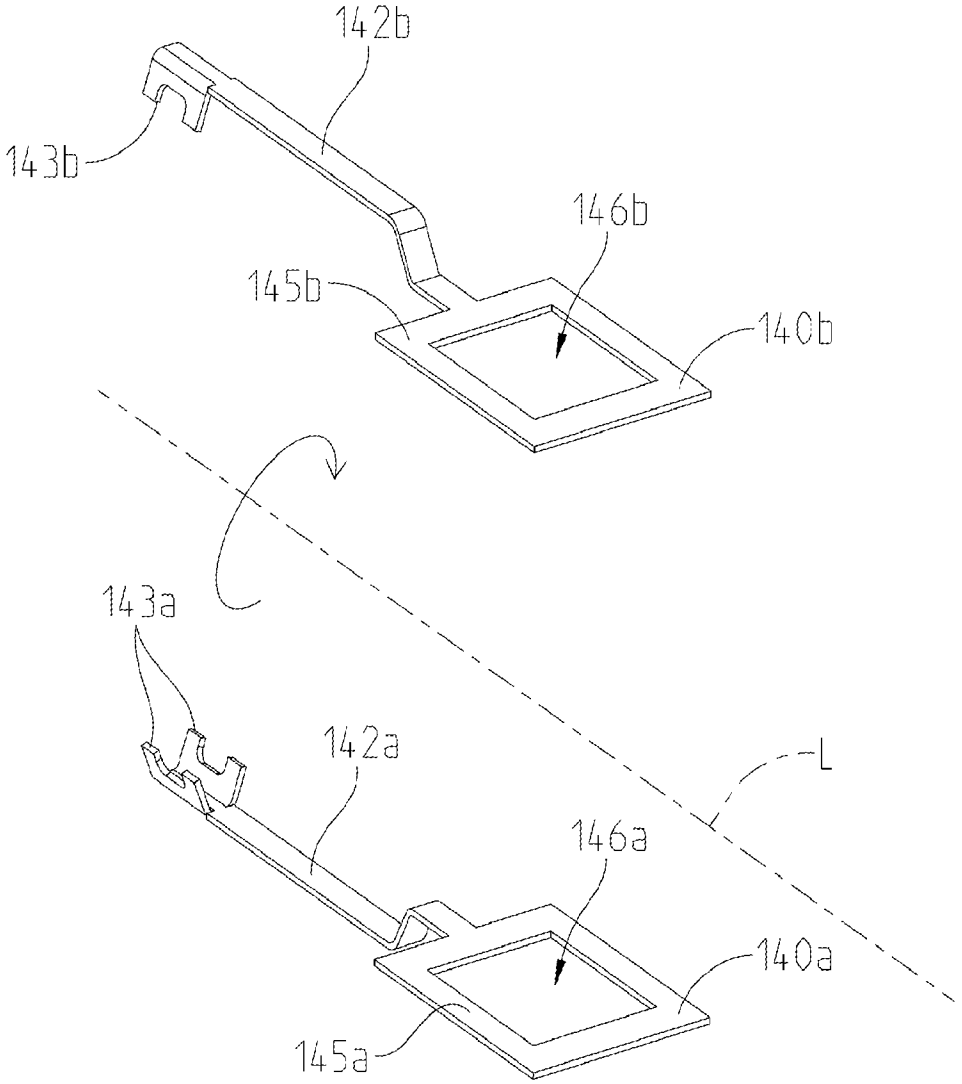
FIG. 8 is a perspective view of the first and second current spreaders of FIG. 4.
Figure 9:
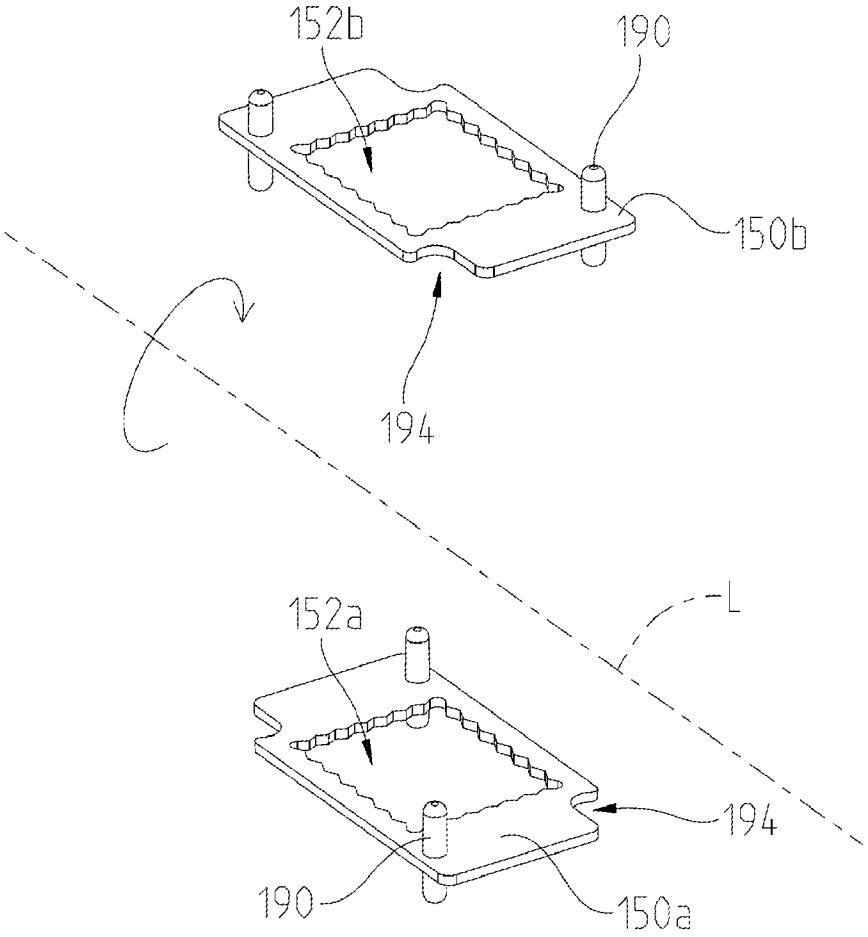
FIG. 9 is a perspective view of the first and second frames of FIG. 4.

Corresponding components of the electrolytic cell assembly 120 may be identical in construction and rotated into the desired orientation. As shown in FIG. 7, the same housing component may be placed in a first orientation for use as the first housing 130*a* or rotated 180 degrees about the longitudinal axis L for use as the second housing 130*b*. The housing component may have opposite registration features located on opposite sides of the longitudinal axis L such that, when rotated, the registration posts 180 on the first housing 130*a* correspond with the registration holes 182 in the second housing 130*b*, and vice versa. As shown in FIG. 8, the same current spreader component may be placed in a first orientation for use as the first current spreader 140*a* or rotated 180 degrees about the longitudinal axis L for use as the second current spreader 140*b*. As shown in FIG. 9, the same frame component may be placed in a first orientation for use as the first frame 150*a* or rotated 180 degrees about the longitudinal axis L for use as the second frame 150*b*. The frame component may have opposite registration features located on opposite sides of the longitudinal axis L such that, when rotated, the registration posts 190 on the first frame 150*a* correspond with notches 194 in the second frame 150*b*, and vice versa. Advantageously, these identical constructions may reduce manufacturing, inventory, and replacement costs and may facilitate the assembly process.

Returning to FIG. 3, the ozone generator 100 defines a first water flow path 200*a* in fluid communication with the first electrode 160*a* and a second water flow path 200*b* in fluid communication with the second electrode 160*b*. The first water flow path 200*a* is illustratively formed between the outer cartridge 112 and the first housing 130*a*, and the second water flow path 200*b* is illustratively formed between the outer cartridge 112 and the second housing 130*b*. Advantageously, forming the flow paths 200*a*, 200*b* between the cartridge 112 and the housings 130*a*, 130*b* may ease mold design, tooling, and molding. Also, forming the flow paths 200*a*, 200*b* between the cartridge 112 and the housings 130*a*, 130*b* may take advantage of the sealing rings 132 around the housings 130*a*, 130*b* to force the water flow through the desired flow paths 200*a*, 200*b*, not freely around the housings 130*a*, 130*b*.

The first water flow path 200*a* is described further herein, but the same description may apply to the second water flow path 200*b*. In FIG. 3, the first water flow path 200*a* begins at a first inlet 202*a* located in the cylindrical sidewall of the cartridge 112. From the first inlet 202*a*, the first water flow path 200*a* travels around a first ribbed barrier 204*a* that projects inwardly from the first housing 130*a*. Specifically, the first water flow path 200*a* travels: (1) toward the back side 162*a* of the first electrode 160*a* in a direction perpendicular to the first electrode 160*a* and the longitudinal axis L, (2) around a 90 degree bend, (3) across the back side 162*a* of the first electrode 160*a* in a direction parallel to the first electrode 160*a* and the longitudinal axis L, (4) around another 90 degree bend, and (5) away from the back side 162*a* of the first electrode 160*a* in a direction perpendicular to the first electrode 160*a* and the longitudinal axis L. Finally, the first water flow path 200*a* travels to a first outlet 206*a* located in the longitudinal end of the cartridge 112. Upon exiting the cartridge 112, the first water flow path 200*a* may re-combine with the second water flow path 200*b*.

The water flow paths 200*a*, 200*b* may be designed to create high water velocity with low turbulence across the electrodes 160*a*, 160*b*. Creating a high water velocity may help flush away bubbles from the electrodes 160*a*, 160*b* when the bubbles are still small in size, before they have time to rest and expand, thereby making room for more water to contact the electrodes 160*a*, 160*b*, avoiding bubble attachment on the electrodes 160*a*, 160*b*, and avoiding entrapment of gas products in large bubbles. Creating a high water velocity may also promote hydration of the separator 170. In certain embodiments, the height of the gap or clearance 208*a* between the first barrier 204*a* in the first housing 130*a* and the back side 162*a* of the first electrode 160*a* may be controlled to optimize the water flow therebetween.

In operation, electric current is applied to the electrodes 160*a*, 160*b* causing electrolysis to occur in the electrolytic cell assembly 120. Specifically, a positive electric potential is applied to one electrode (e.g., the first electrode 160*a*) to form an anode, and a negative electric potential is applied to the other electrode (e.g., the second electrode 160*b*) to form a cathode. As a result, a voltage differential may be produced across the first electrode 160*a* and the second electrode 160*b*. The electric potential may be applied using a power source (not shown), which may be coupled to the first and second terminals 142*a*, 142*b* via first and second leads 144*a*, 144*b*, respectively. The water flowing through the electrolytic cell assembly 120 may serve as the electrolytic solution without the need for an additional electrolytic solution.

At the positive anode (e.g., the first electrode 160*a*), the water is electrolyzed and broken down into oxygen ions and hydrogen ions. At least some of the oxygen ions are converted to ozone ($O_3$) due to the higher over-potential voltage of the conductive diamond coating on the anode. The ozone may dissolve into the water to perform a disinfecting function in the water. The remaining oxygen ions may be converted to more stable oxygen ($O_2$), which may have little value in this application. Electrons from the electrolyzed water are transported to the cathode (e.g., the second electrode 160*b*) via the leads 144*a*, 144*b*, while hydrogen ions (i.e., protons) from the electrolyzed water are transported to the cathode across the separator 170. At the cathode, the hydrogen ions and the electrons from the electrolyzed water recombine to form hydrogen ($H_2$) bubbles. The water streams passing over the electrodes 160*a*, 160*b* sweep away the $O_3$ and $O_2$ from the anode and the $H_2$ from the cathode. The same water streams also supply fresh water to replenish the water consumed during electrolysis.

In certain embodiments, the polarity of the electrolytic cell assembly 120 may be selectively reversed to reduce scale build-up. In a first state, the first electrode 160*a* may serve as the anode, and the second electrode 160*b* may serve as the cathode, for example. In a second state, the first electrode 160*a* may be switched from the anode to the cathode, and the second electrode 160*b* may be switched from the cathode to the anode. The reversed state may also force water through the separator 170 to pre-hydrate the anode upon return to the first state. The duration of the reversed state may be relatively short, such as about 20 seconds or less.

Figure 10:
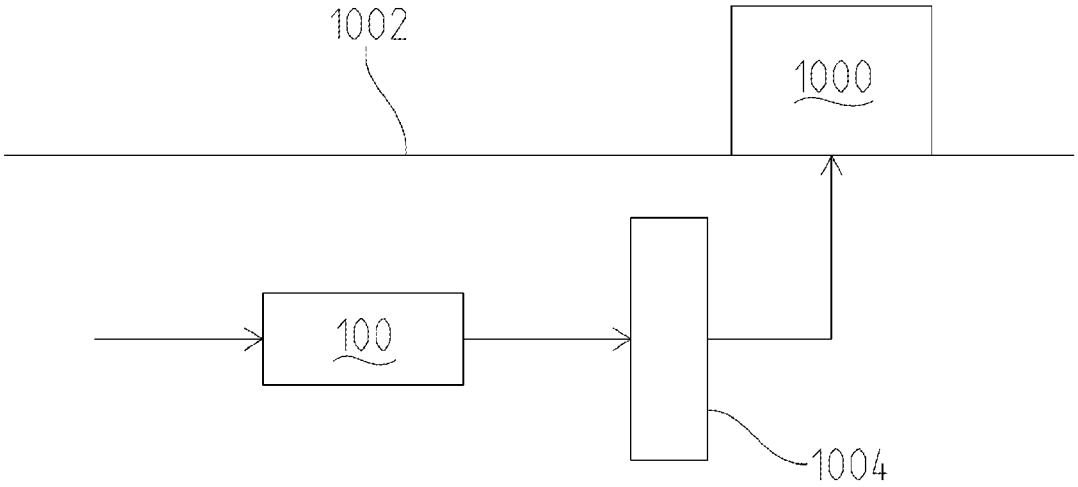
FIG. 10 is a schematic view of the ozone generator of FIG. 1 in fluid communication with a faucet.
Figure 11:
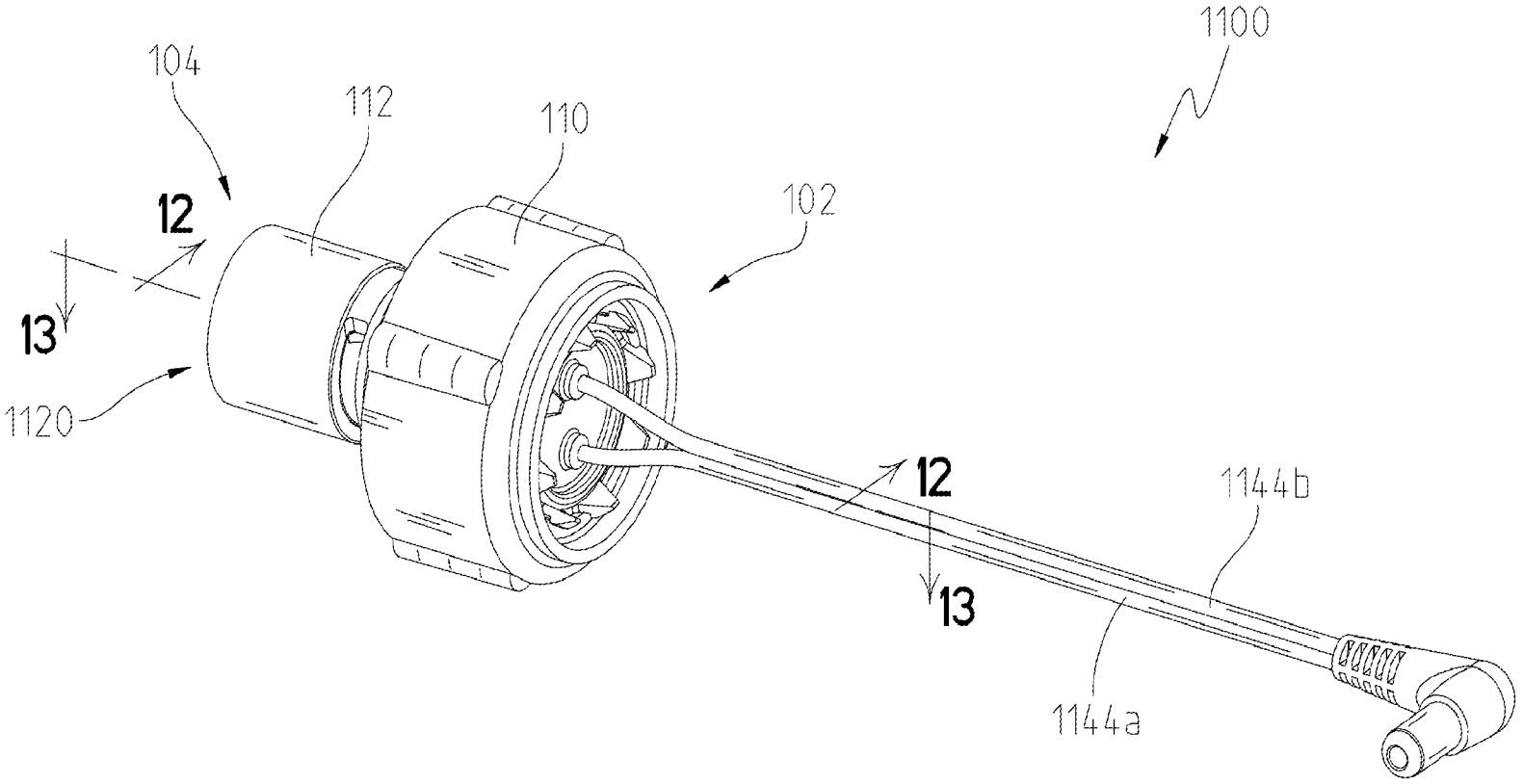
FIG. 11 is an assembled perspective view of a further exemplary ozone generator of the present disclosure.
Figure 12:
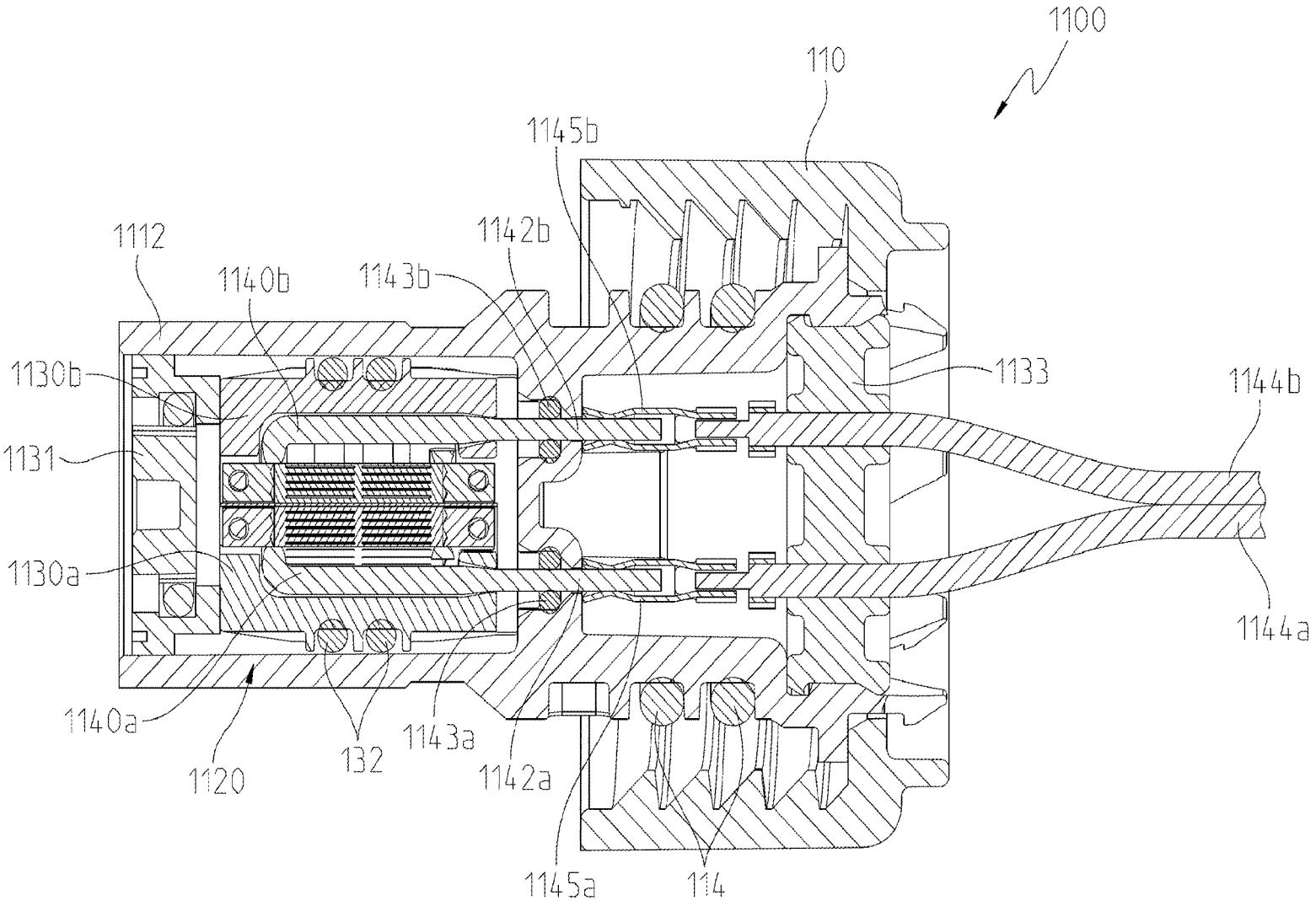
FIG. 12 is a cross-sectional view of the ozone generator of FIG. 11, taken along line 12-12 of FIG. 11.
Figure 13:
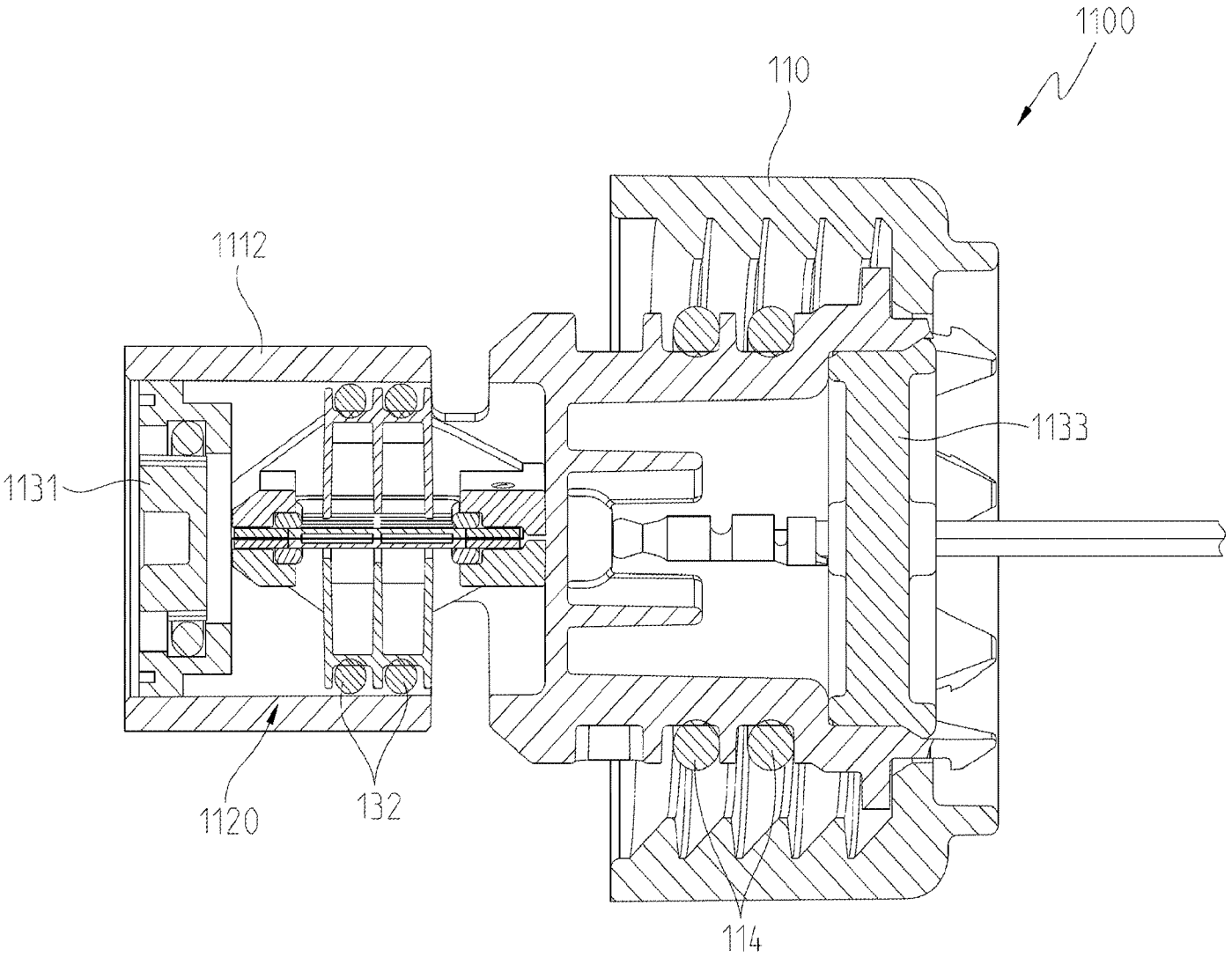
FIG. 13 is another cross-sectional view of the ozone generator of FIG. 11, taken along line 13-13 of FIG. 11.
Figure 14:
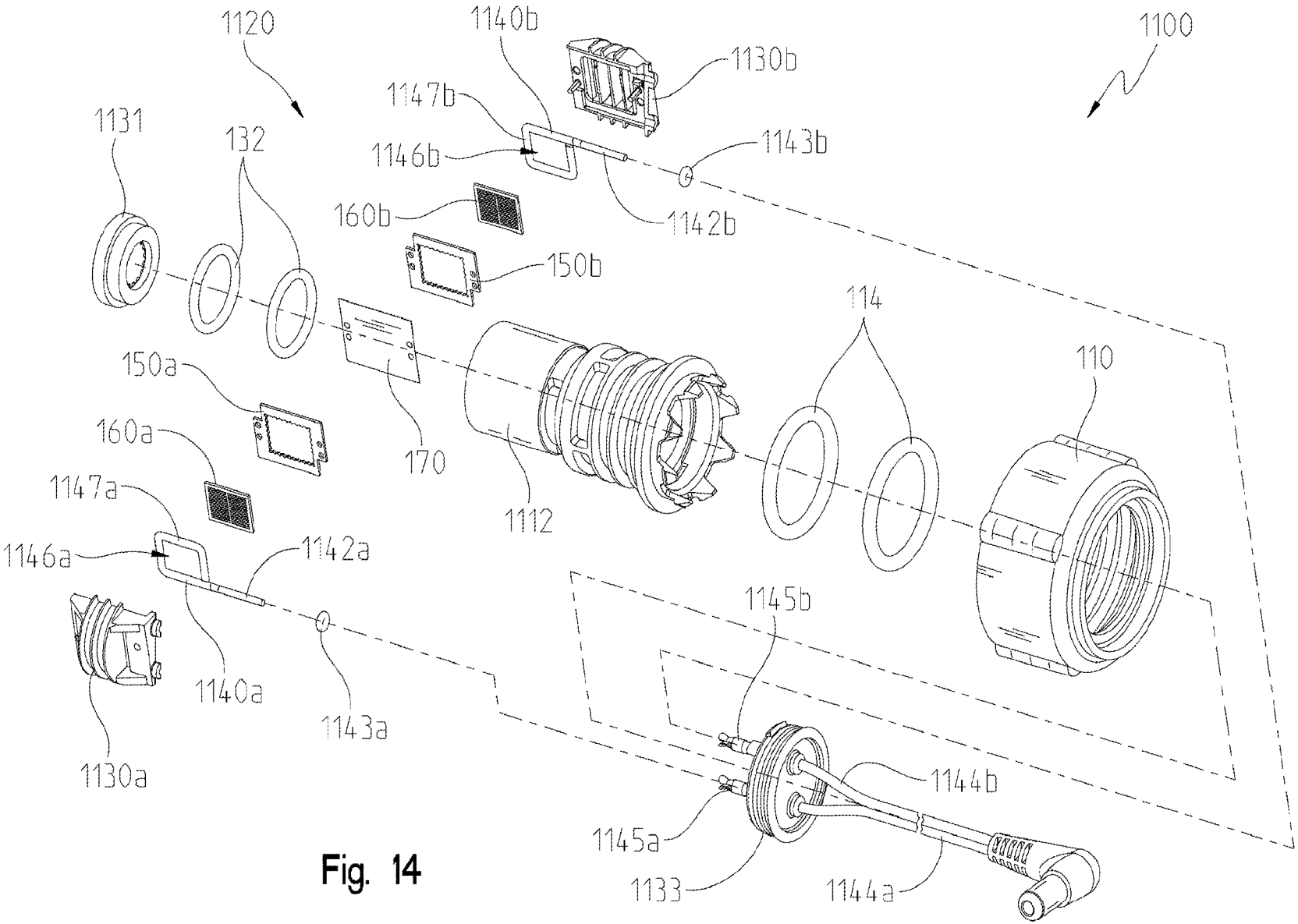
FIG. 14 is an exploded perspective view of the ozone generator of FIG. 11, the ozone generator including first and second housings, first and second current spreaders, first and second frames, first and second electrodes, and a separator.
Figure 15:
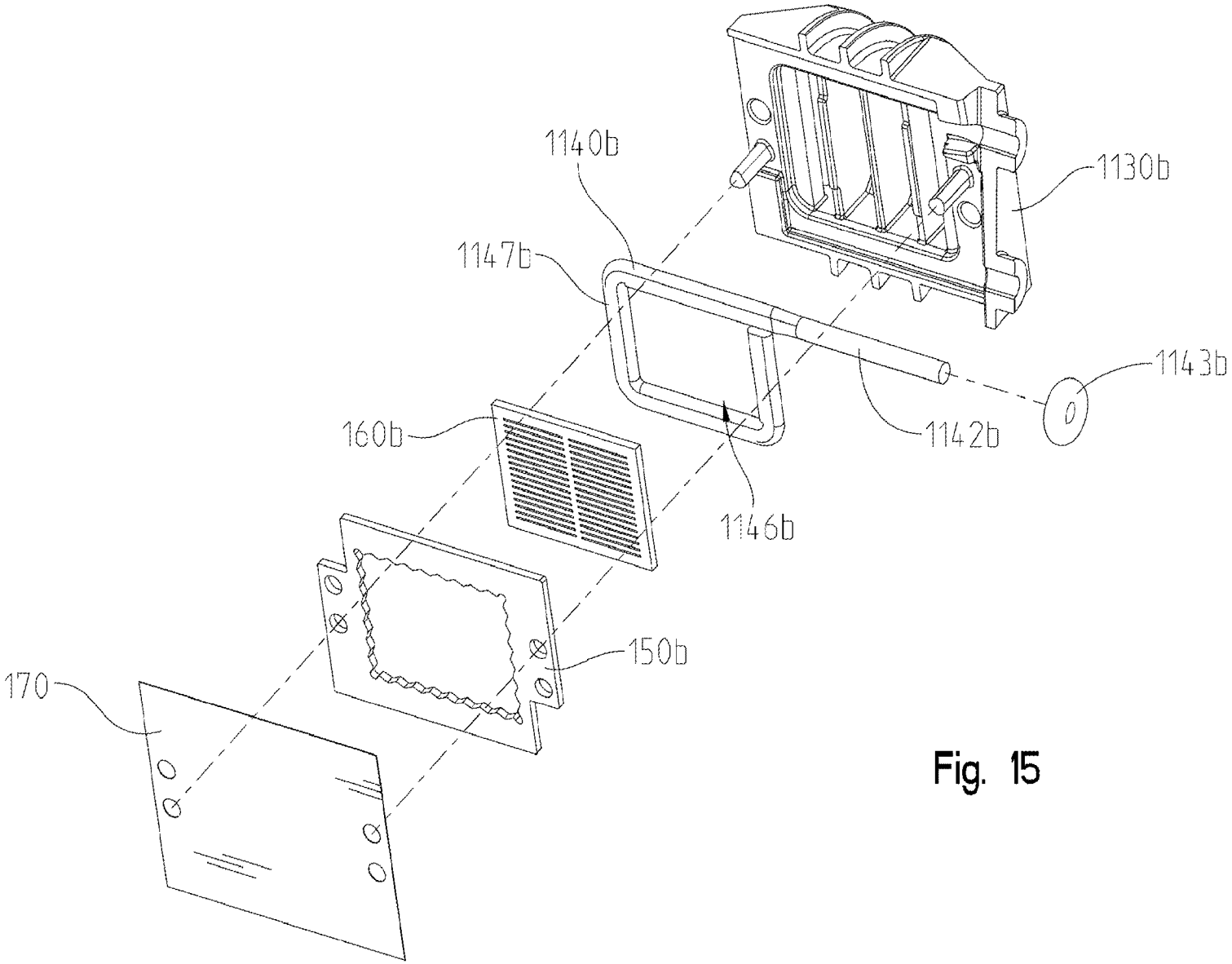
FIG. 15 is an exploded perspective view of the first housing, the first current spreader, the first frame, the first electrode, and the separator of FIG. 14.

Referring next to FIG. 10, the ozone generator 100 may be installed in fluid communication with a faucet 1000. For example, the ozone generator 100 may be installed beneath a sink deck 1002 in fluid communication with the faucet 1000. In certain embodiments, the ozone generated by the ozone generator 100 may remain in the water upon reaching the faucet 1000 to continue performing the disinfecting function. In this embodiment, the ozone-containing water from the faucet 1000 may be used as a disinfectant or a cleaning agent, for example. In other embodiments, the ozone generated by the ozone generator 100 may perform an initial disinfecting function in the water but, before reaching the faucet 1000, the ozone may be destroyed or otherwise removed from the water. For example, as shown in FIG. 10, a filter 1004 (e.g., a carbon black filter) may be provided downstream of the ozone generator 100 and upstream of the faucet 1000, which gives the ozone from the ozone generator 100 time to initially treat the water before being removed by the filter 1004. In this embodiment, the treated water from the faucet 1000 may be used as drinking water, for example.

Additional information regarding an illustrative use of the ozone generator 100 is disclosed in U.S. Patent Application Publication No. 2014/352799 to Rosko et al., entitled "Ozone Distribution in a Faucet", the entire disclosure of which is expressly incorporated herein by reference.

Referring now to FIGS. 11-14, a further illustrative ozone generator 1100 is shown as including many of the same components as ozone generator 100 detailed above. In the following description, similar components to those of ozone generator 100 are identified with like reference numbers.

The ozone generator 1100 includes an electrolytic cell assembly 1120 located inside a cartridge 1112. The illustrative electrolytic cell assembly 1120 includes a first housing or carrier 1130*a* and a second housing or carrier 1130*b*, a first current spreader 1140*a* and a second current spreader 1140*b*, a first frame 150*a* and a second frame 150*b*, a first electrode 160*a* and a second electrode 160*b*, and a separator 170.

The first and second housings 1130*a*, 1130*b* of the electrolytic cell assembly 120 are compressed together with the other components of the electrolytic cell assembly 1120 being mechanically and electrically sandwiched therebetween. Sealing rings 132, illustratively elastomeric o-rings, are positioned around the housings 1130*a*, 1130*b* to hold the housings 1130*a*, 1130*b* together. The housings 1130*a*, 1130*b* may be held together by the sealing rings 132 independently of the outer cartridge 1112 to facilitate storage and assembly of the electrolytic cell assembly 1112, with or without cartridge 1112 in place. It is also within the scope of the present disclosure that the first and second housings 1130*a*, 1130*b* may be clamped, fastened, or otherwise held together. The housings 1130*a*, 1130*b* are constructed of an electrically insulating material, such as a polymer. End caps 1131 and 1133 may be secured to opposing ends of the cartridge 1112. End cap 1131 is illustratively a flow restrictor configured to limit flow rate into the ozone generator 1100. End cap 1133 is illustratively an elastomeric seal through which the wire leads 1144*a* and 1144*b* extend.

The first and second current spreaders 1140*a*, 1140*b* of the electrolytic cell assembly 120 mate with the first and second housings 1130*a*, 1130*b*, respectively. The current spreaders

1140*a*, 1140*b* are constructed of an electrically conductive material, such as a wire formed of titanium or another suitable material. The first current spreader 1140*a* includes a first terminal 1142*a* that extends out of the first housing 1130*a* in a sealed manner for electrical communication with a first wire lead 1144*a*. The first terminal 1142*a* is illustratively circular in cross-section to define a pin connector for electrical communication with a conventional socket 1145*a* supported by the end cap 1133. An o-ring 1143*a* is received on the first terminal 1142*a*. Likewise, the second current spreader 1140*b* includes a second terminal 1142*b* that extends out of the second housing 1130*b* in a sealed manner for electrical communication with a second wire lead 1144*b*. The second terminal 1142*b* is illustratively circular in cross-section to define a pin connector for electrical communication with a conventional socket 1145*b* supported by the end cap 1133. An o-ring 1143*b* is received on the second terminal 1142*b*.

The first current spreader 1140*a* also includes a first rectangular body 1147*a* defining a first opening 1146*a* that is sized and shaped to receive and expose the first electrode 160*a*. Likewise, the second current spreader 1140*b* includes a second rectangular body 1147*b* defining a second opening 1146*b* that is sized and shaped to receive and expose the second electrode 160*b*. The bodies 1147*a* and 1147*b* are illustratively planar wherein the openings 1146*a*, 1146*b* in the current spreaders 1140*a*, 1140*b* may be flush with the surrounding housings 1130*a*, 1130*b*. The bodies 1147*a* and 1147*b* define a closed loop to provide enhanced contact with the electrodes 160*a* and 160*b*, respectively.

With reference now to FIGS. 16-27, an illustrative ozone system 1200 for use with faucet 1000 is shown as including ozone generator 1100. In the following description, similar components to those of ozone generator 1100 detailed above are identified with like reference numbers. It should be appreciated that other ozone generators, such as ozone generator 100, may be also used in the ozone system 1200.

Figure 21:
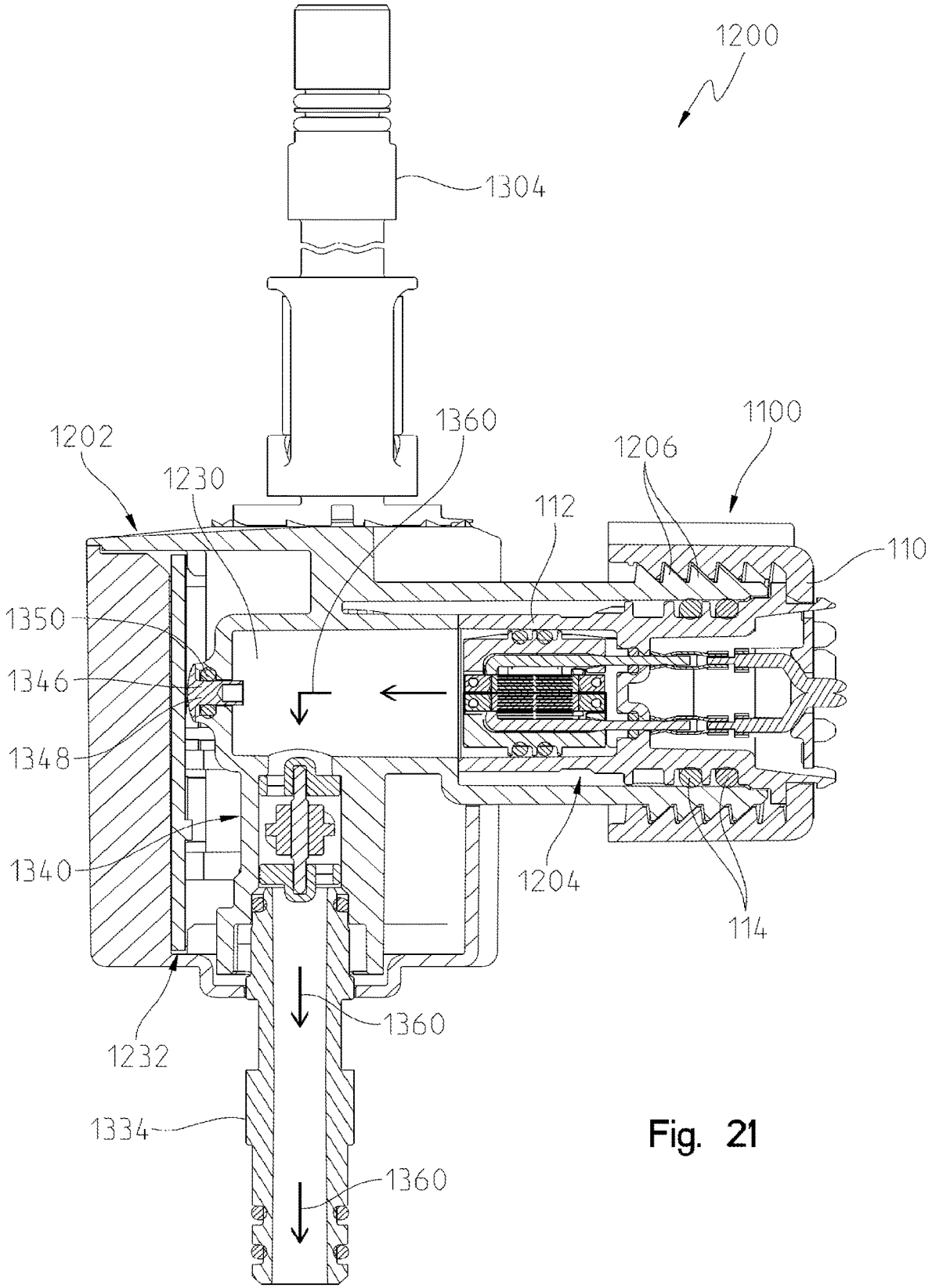
FIG. 21 is a cross-sectional view taken along line 21-21 of FIG. 16.

Referring to FIGS. 16-18 and 21, a solenoid valve body 1202 includes an ozone generator receiving chamber 1204 receiving the ozone generator 1100. External threads 1206 of the solenoid valve body 1202 cooperate with the internally threaded pipe fitting 110 of the ozone generator 1100. Sealing rings 114 promote a sealed connection between the pipe fitting 110, the cartridge 1112, and the solenoid valve body 1202 (FIG. 21).

Figure 18:
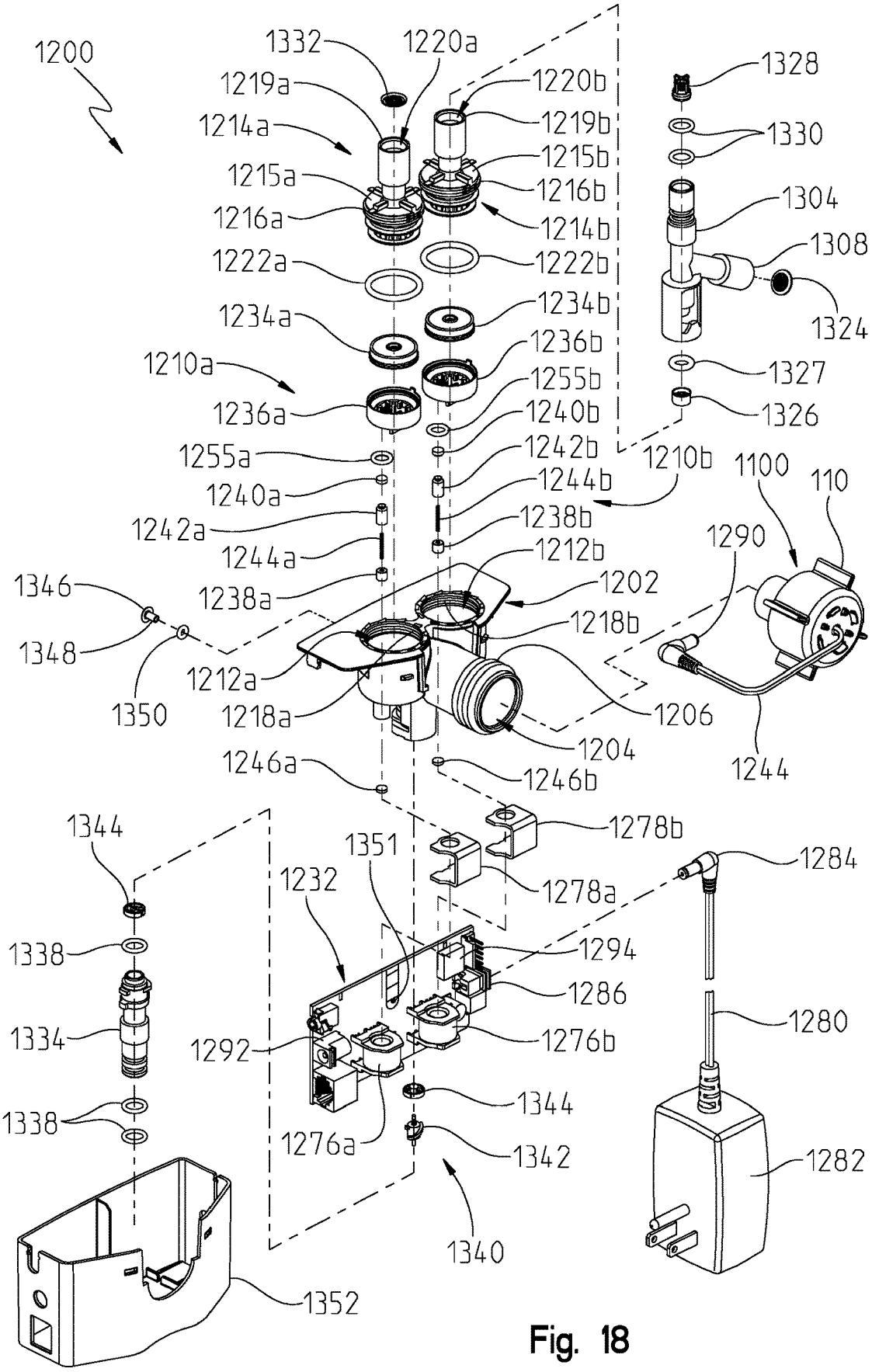
FIG. 18 is an exploded perspective view of the illustrative system of FIG. 17.
Figure 22:
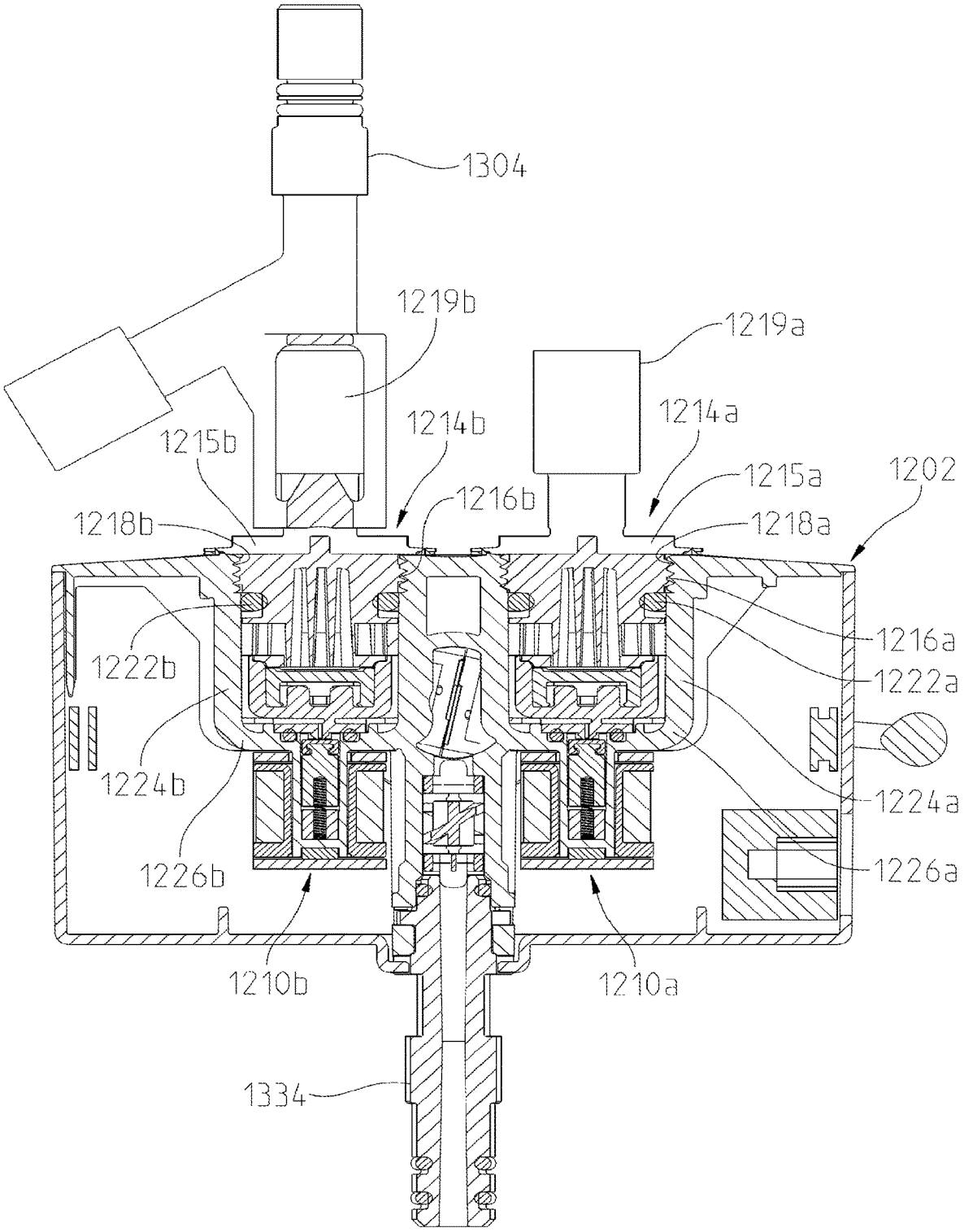
FIG. 22 is a cross-sectional view taken along line 22-22 of FIG. 16.

With reference to FIGS. 18 and 22, first, or mixed water, pilot operated diaphragm solenoid valve 1210*a* is received within a first valve receiving chamber 1212*a* of the valve body 1202. A second, or ozone, pilot operated diaphragm solenoid valve 1210*b* is received within a second valve receiving chamber 1212*b* of the valve body 1202. As further detailed herein, the valve receiving chamber 1212*b* is in fluid communication with the ozone generator receiving chamber 1204 through the valve body 1202. Inlet housings or retainers 1214*a* and 1214*b* secure the solenoid valves 1210*a* and 1210*b* within the valve receiving chambers 1212*a* and 1212*b*. More particularly, the inlet retainers 1214*a*, 1214*b* each include a retainer body 1215*a*, 1215*b* supporting external threads 1216*a*, 1216*b* that mate with internal threads 1218*a*, 1218*b* of the valve body 1202 to secure the inlet retainers 1214*a*, 1214*b* within the valve receiving chambers 1212*a*, 1212*b*. The retainer bodies 1215*a*, 1215*b* include connector tubes 1219*a*, 1219*b* extend outwardly from valve body 1202. Fluid passageways 1220*a*, 1220*b* extend through the inlet retainers 1214*a*, 1214*b*. Sealing rings 1222*a*, 1222*b* promote sealed connections between the retainers 1214*a*, 1214*b* and the solenoid valve body 1202.

Figure 23:
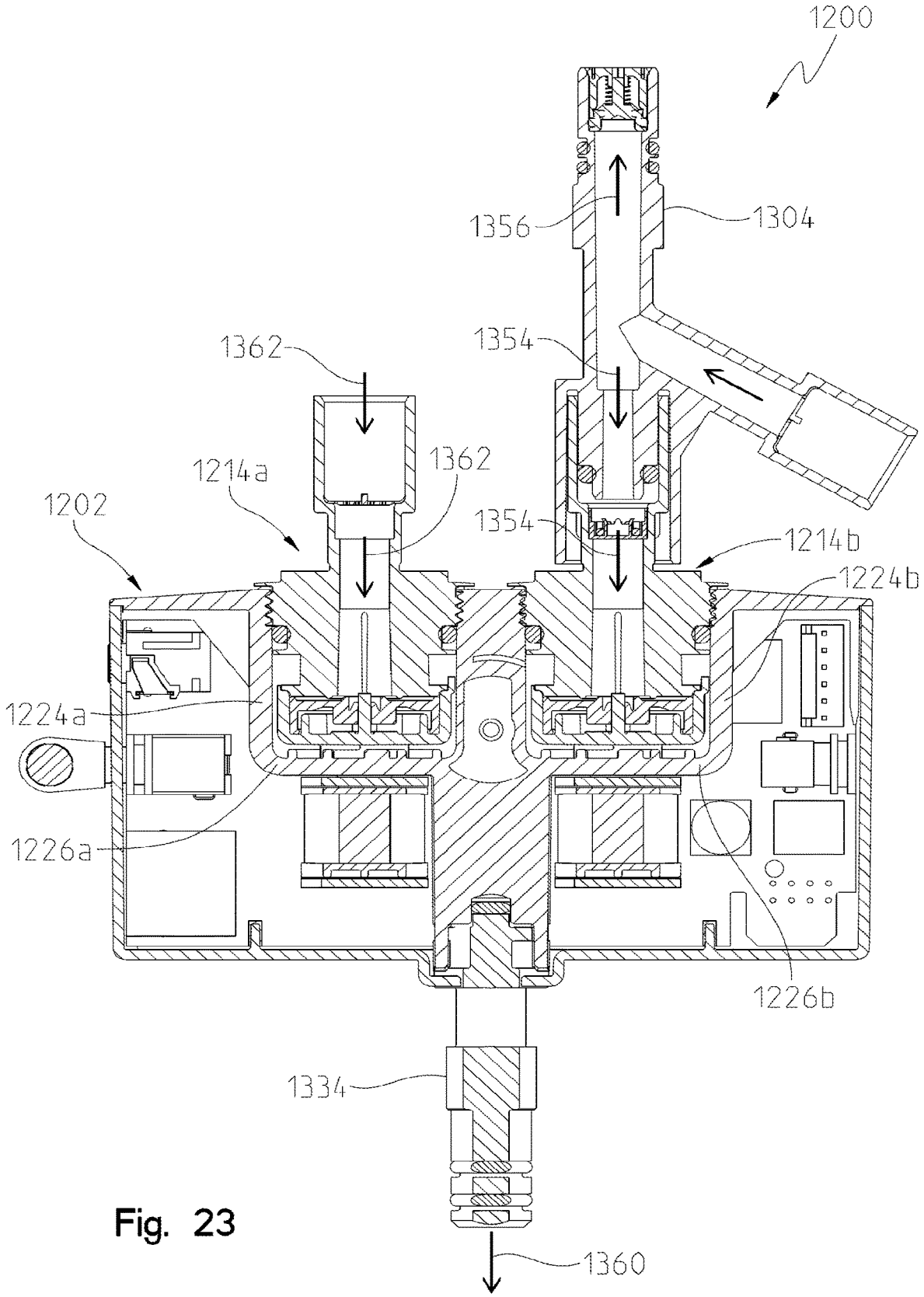
FIG. 23 is a cross-sectional view taken along line 23-23 of FIG. 17.
Figure 24:
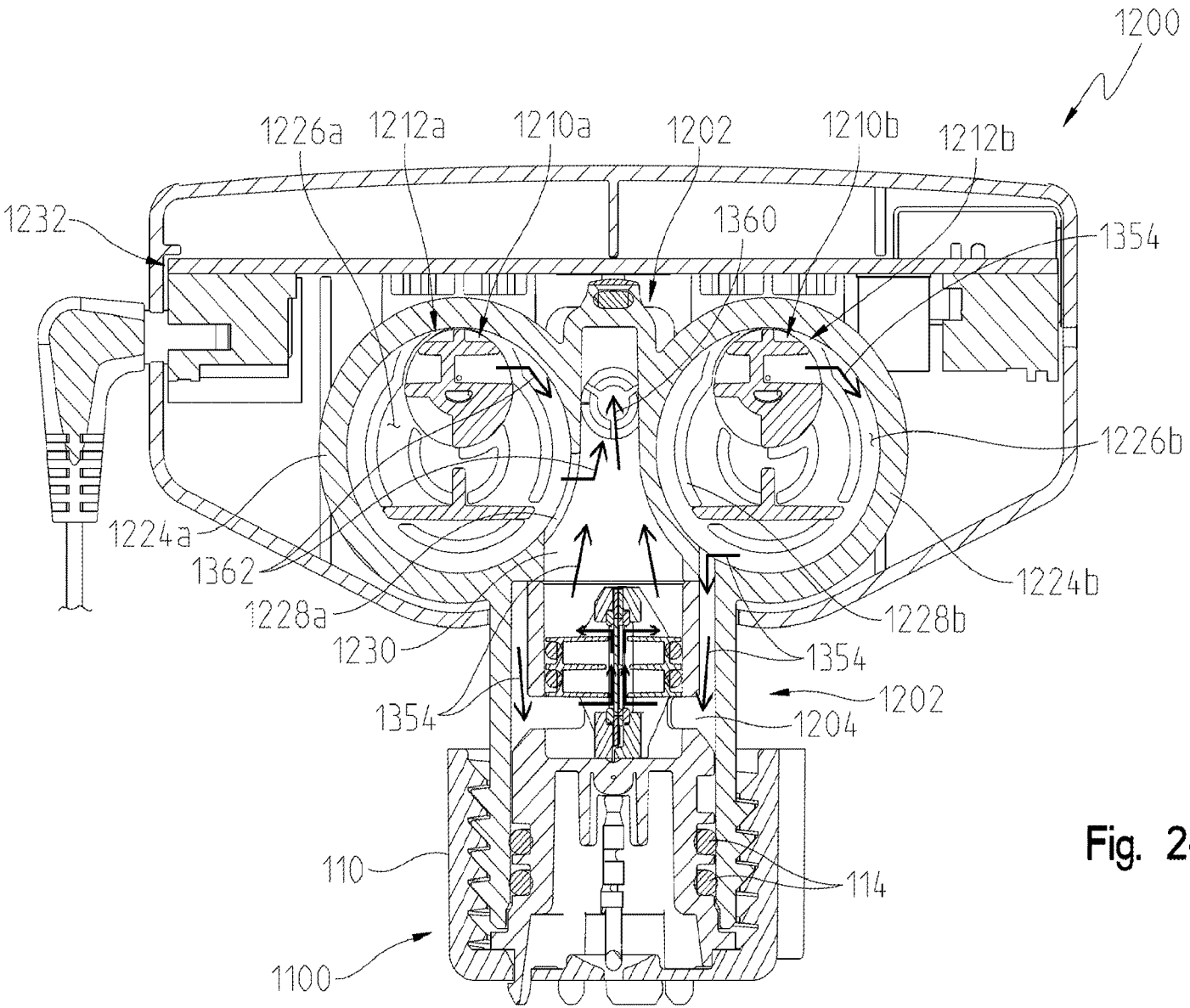
FIG. 24 is a cross-sectional view taken along line 24-24 of FIG. 16.

Referring now to FIGS. 22-24, each valve receiving chamber 1212*a*, 1212*b* of the valve body 1202 includes a cylindrical side wall 1224*a*, 1224*b* extending upwardly from a base 1226*a*, 1226*b*. A first radial opening or slot 1228*a* in the side wall 1224*a* provides fluid communication between the valve receiving chamber 1212*a* (and the first solenoid valve 1210*a*) and an outlet passageway 1230 (FIG. 24). A second radial opening or slot 1228*b* in the side wall 1224*b* provides fluid communication between the valve receiving chamber 1212*b* (and the first solenoid valve 1210*a*) and the ozone generator receiving chamber 1204 (and the ozone generator 1100). After passing through the ozone generator 100 in the manner further detailed above, water flows to the outlet passageway 1230 (FIG. 24).

Figure 19:
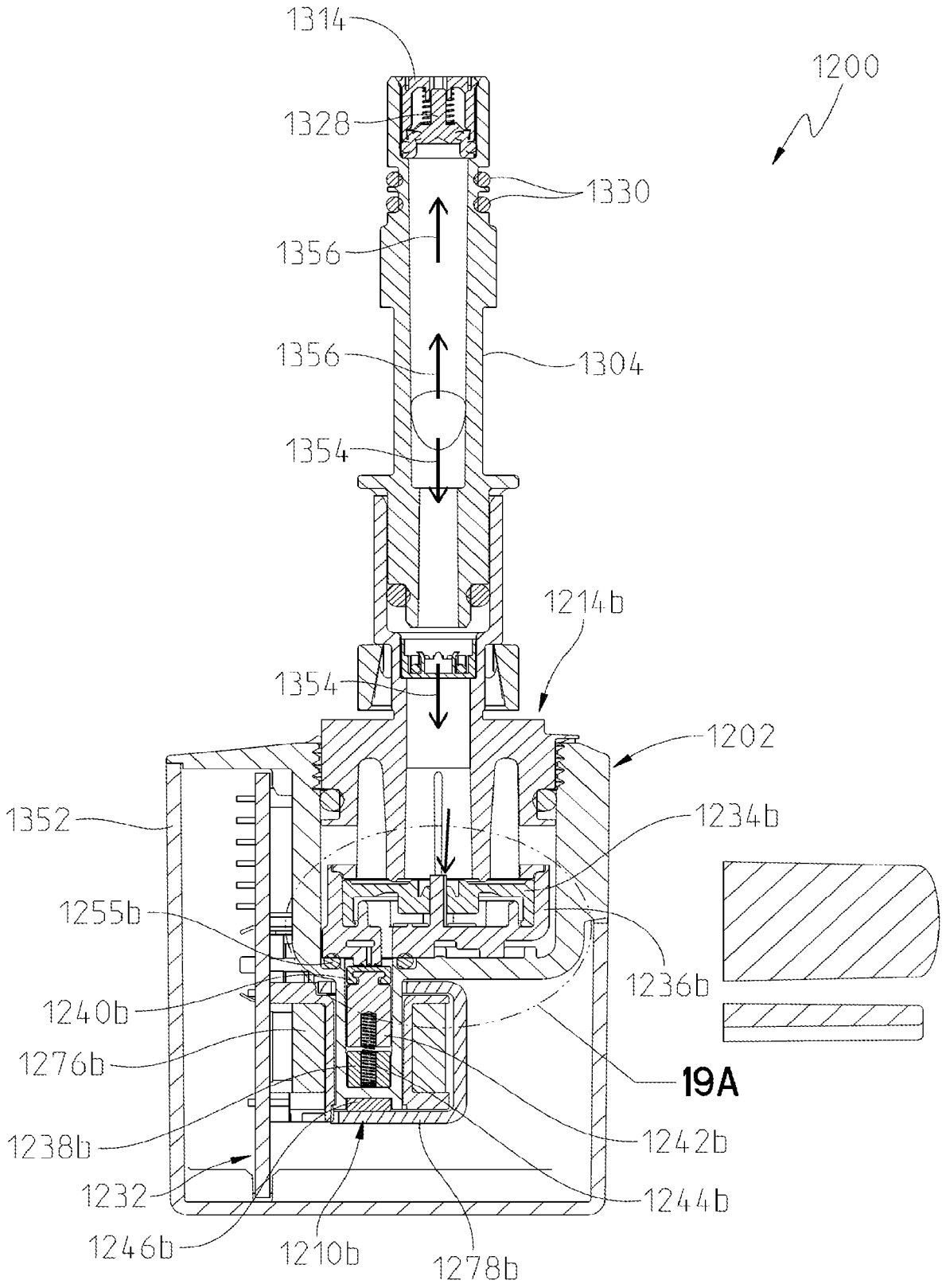
FIG. 19 is a cross-sectional view taken along line 19-19 of FIG. 16.
Figure 25:
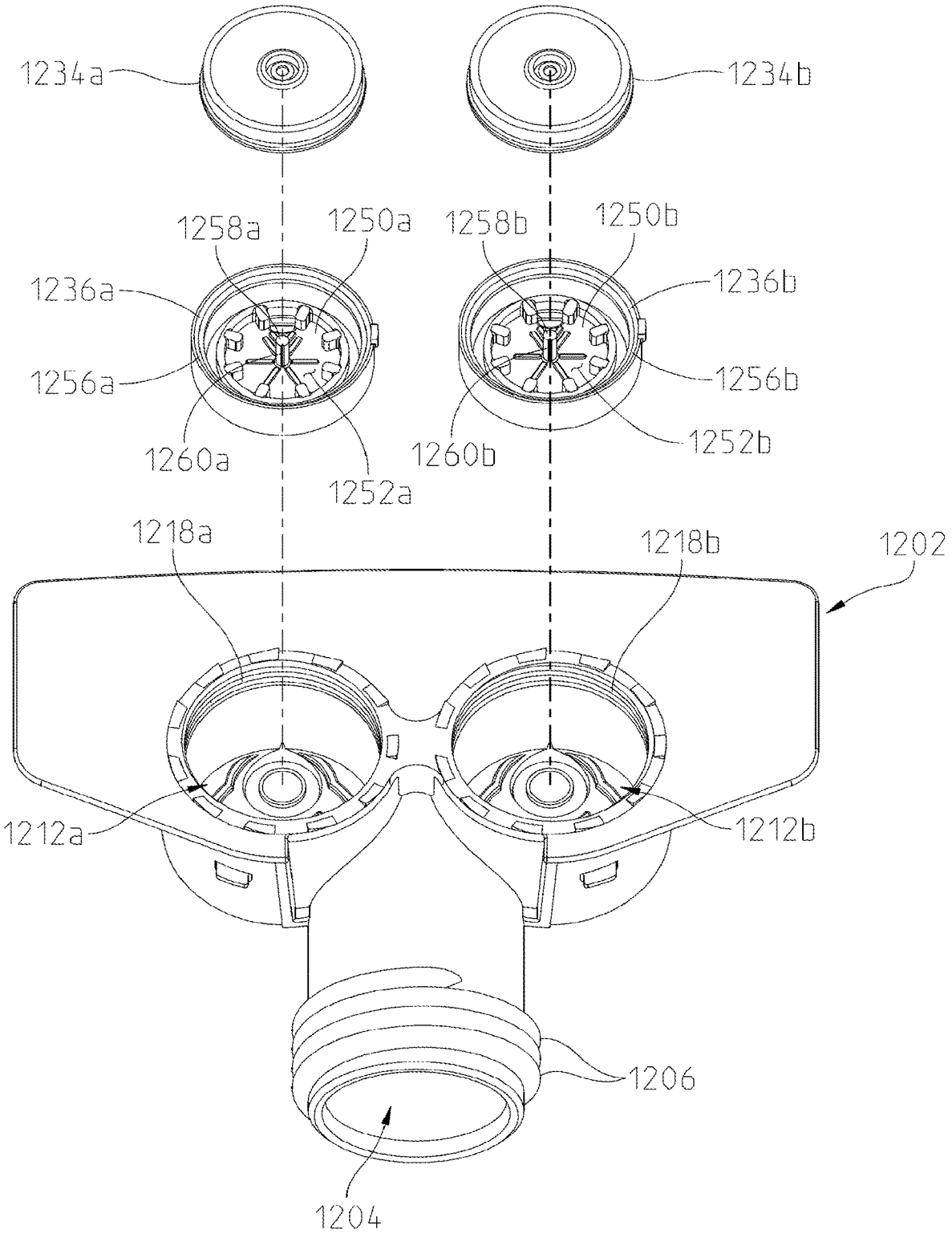
FIG. 25 is a first partially exploded perspective view of the system of FIG. 17.
Figure 26:
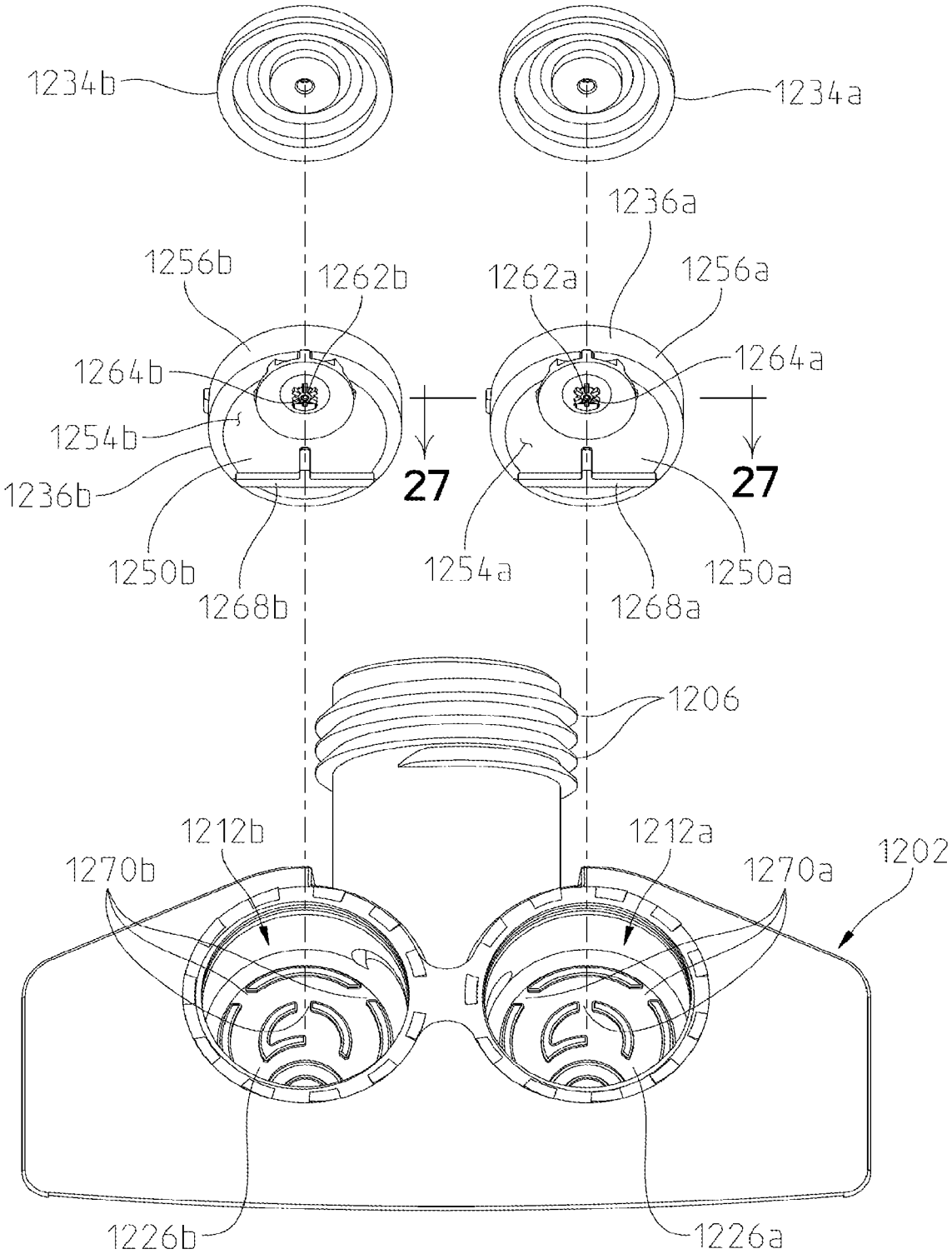
FIG. 26 is a second partially exploded perspective view of the system of FIG. 17.
Figure 27:
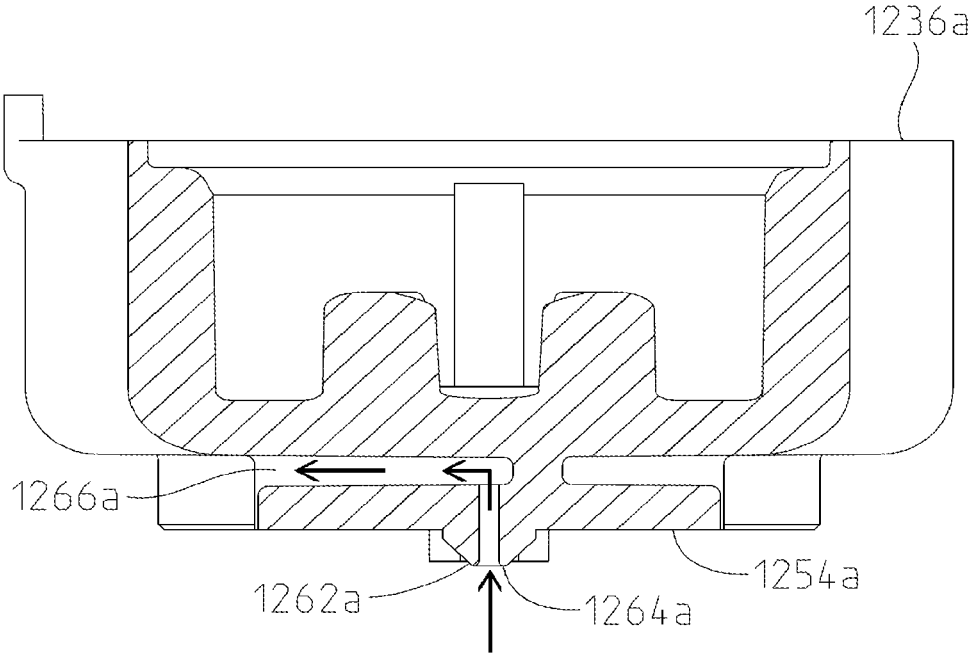
FIG. 27 is a side view, in partial cross-section, of the solenoid housing of FIG. 25.

With reference to FIGS. 18 and 19, a support, illustratively a printed circuit board 1232 supports the solenoid valves 1210*a* and 1210*b*. Each of the solenoid valves 1210*a* and 1210*b* are substantially identical and illustratively includes a main valve disc or diaphragm 1234*a*, 1234*b*, a diaphragm housing 1236*a*, 1236*b*, a solenoid pole 1238*a*, 1238*b*, a seal 1240*a*, 1240*b*, a solenoid armature 1242*a*, 1242*b*, a helical compression spring 1244*a*, 1244*b*, and a magnet 1246*a*, 1246*b*. The diaphragm housing 1236*a*, 1236*b* includes a base 1250*a*, 1250*b* having an upper surface 1252*a*, 1252*b* and a lower surface 1254*a*, 1254*b*. An o-ring 1255*a*, 1255*b* is positioned between the lower surface 1254*a*, 1254*b* of the diaphragm housing 1236*a*, 1236*b* and the base 1226*a*, 1226*b* of the valve receiving chamber 1212*a*, 1212*b*. As shown in FIGS. 25 and 26, a cylindrical side wall 1256*a*, 1256*b* extends upwardly from the upper surface 1252*a*, 1252*b* of the base 1250*a*, 1250*b*. A center post 1258*a*, 1258*b* extends upwardly from the upper surface 1252*a*, 1252*b* of the base 1250*a*, 1250*b* and includes an axial water slot 1260*a*, 1260*b*.

Referring now to FIGS. 19-19B, 26 and 27, a valve seat 1262*a*, 1262*b* is supported by the lower surface 1254*a*, 1254*b* of the base 1250*a*, 1250*b*. An opening 1264*a*, 1264*b* extends within the valve seat 1262*a*, 1262*b* and is in fluid communication with a lateral passageway 1266*a*, 1266*b* within the diaphragm housing 1236*a*, 1236*b*. A T-shaped protrusion 1268*a*, 1268*b* extends downwardly from the lower surface 1254*a*, 1254*b* of the base 1250*a*, 1250*b* and is received within locating slots 1270*a*, 1270*b* in the respective base 1226*a*, 1226*b* to orient and rotationally secure the diaphragm housing 1236*a*, 1236*b* relative to the receiving chamber 1212*a*, 1212*b* of the valve body 1202.

With reference to FIGS. 18 and 19, solenoid coils 1276*a* and 1276*b* and supporting brackets 1278*a* and 1278*b* are fixed to the printed circuit board 1232. As further detailed herein, activation of the solenoid coil 1276*a*, 1276*b* causes axial movement of the solenoid armature 1242*a*, 1242*b* and the seal 1240*a*, 1240*b* away from the valve seat 1262*a*, 1262*b* and opening 1264*a*, 1264*b* of the diaphragm housing 1236*a*, 1236*b*. Spring 1244*a*, 1244*b* biases the armature 1242*a*, 1242*b* and seal 1240*a*, 1240*b* into sealing engagement with the valve seat 1262*a*, 1262*b* to prevent fluid flow through opening 1264*a*, 1264*b* of the diaphragm housing 1236*a*, 1236*b*.

Figure 16:
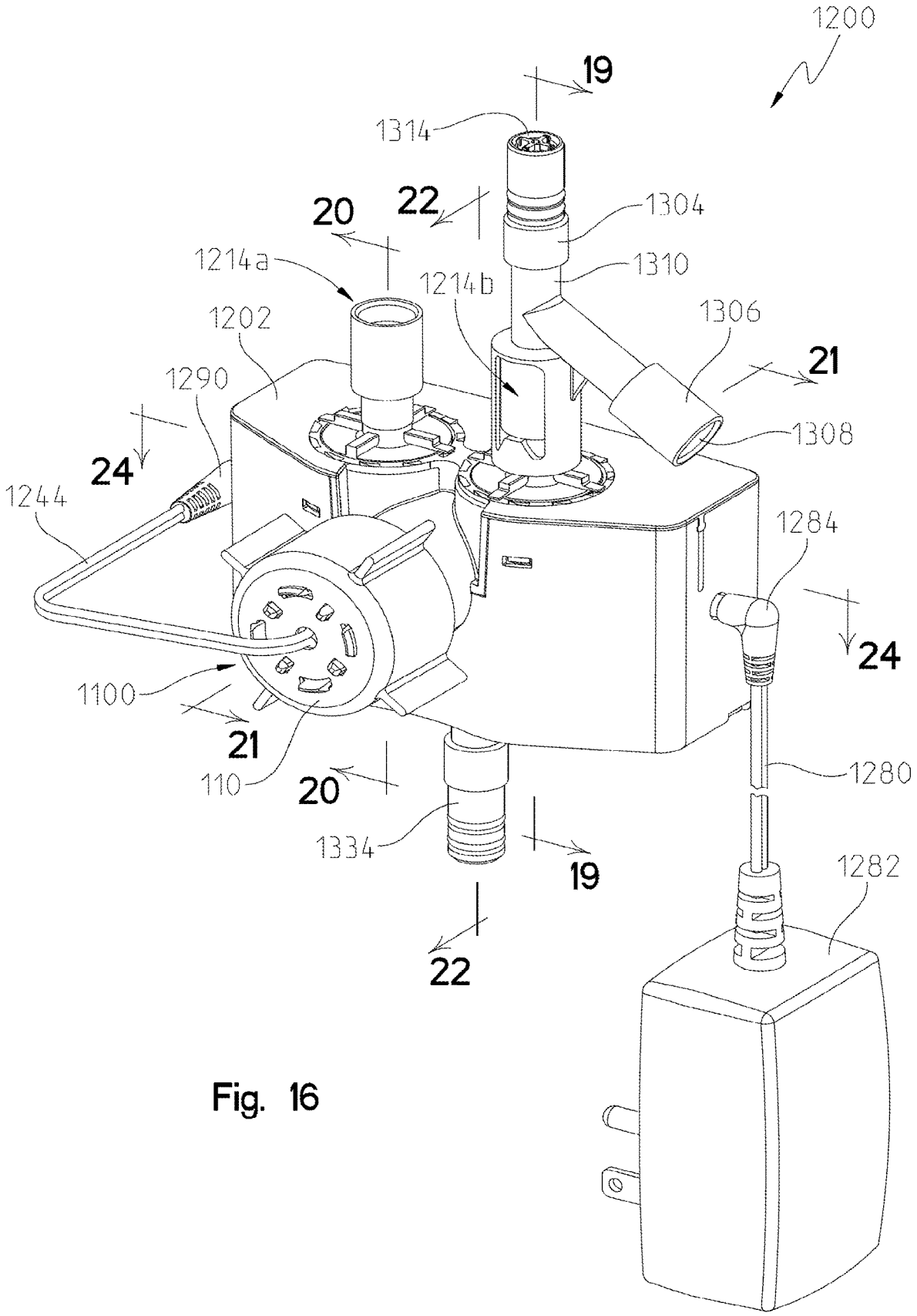
FIG. 16 is a right perspective view of an illustrative system including an ozone generator of the present disclosure.
Figure 17:
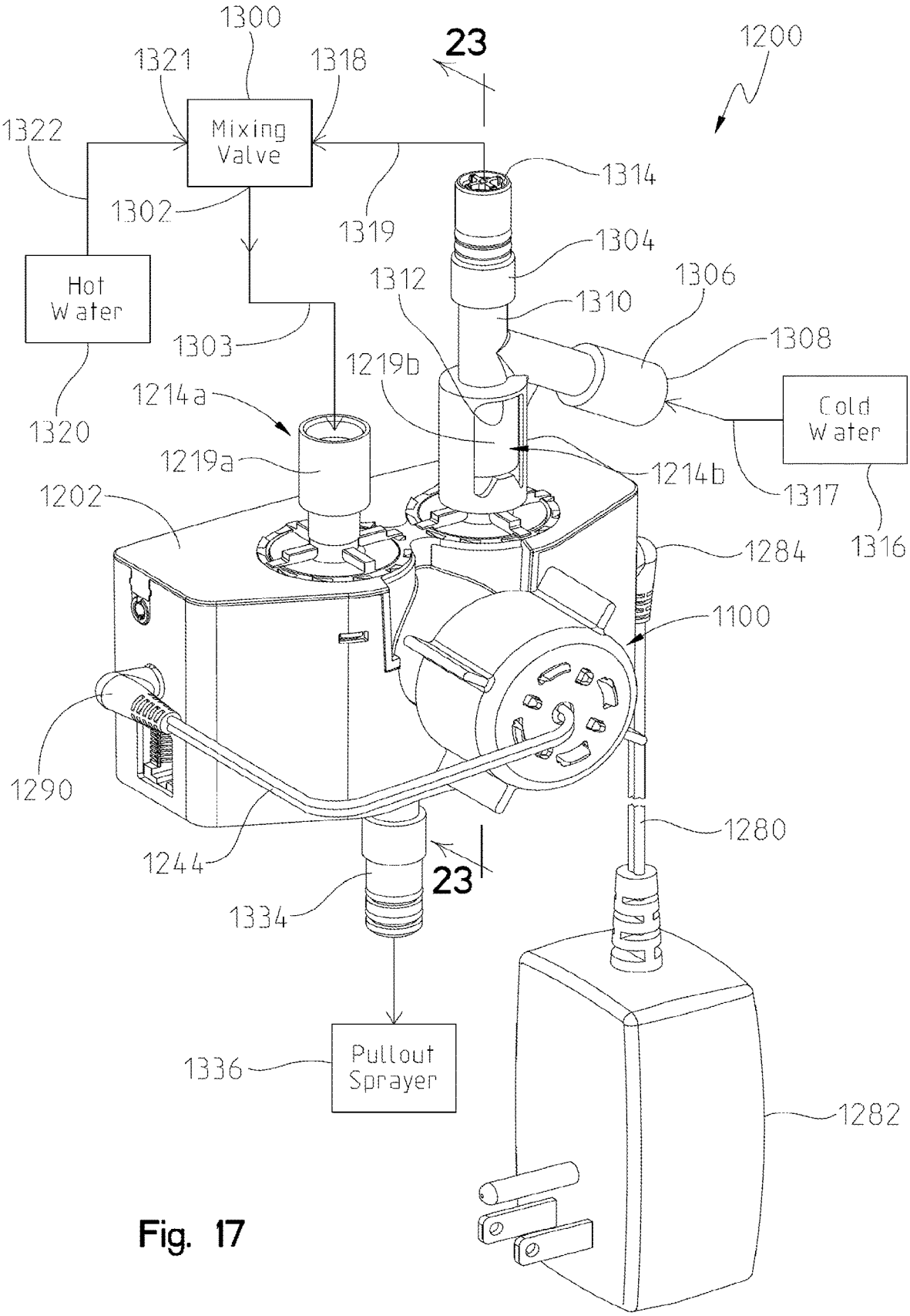
FIG. 17 is left perspective view of the illustrative system of FIG. 16.

With reference to FIGS. 16-18, a power supply (not shown) is illustratively electrically coupled to the printed circuit board 1232 through an electrical cable 1280 including a wall plug 1282 at a first end and a connector 1284 at a second end. The wall plug 1282 illustratively includes an AC to DC 24 volt switching power supply. The connector

1284 is received within a socket 1286 supported by the printed circuit board 1232. Electrical cable 1244 of the ozone generator 1100 includes a connector 1290 coupled to a socket 1292 supported by the printed circuit board 1232. A controller 1294 is illustratively supported by the printed circuit board 1232, and may include a constant current light emitting diode (LED) power integrated circuit (IC) chip. The IC chip is illustratively configured to maintain the current constant as the resistance of the ozone generator 1100 changes over its life (e.g., due to accumulation on and/or degradation of the electrodes).

Referring now to FIG. 17, a conventional mixing valve 1300 is illustratively in fluid communication with the first and second solenoid valves 1210*a* and 1210*b*. More particularly, an outlet 1302 of the mixing valve 1300 is fluidly coupled to the first solenoid valve 1210*a* through conventional fluid line 1303. More particularly, the fluid line 1303 is fluidly coupled to the connector tube 1219*a* of the inlet retainer 1214*a*. A wye fitting 1304 is fluidly coupled to the second retainer 1214*b*. The wye fitting 1304 includes an inlet tube 1306 including an inlet port 1308, and an outlet tube 1310 including a first outlet port 1312 and a second outlet port 1314. The inlet port 1308 of the inlet tube 1306 is illustratively fluidly coupled to a cold water source 1316 through a conventional fluid line 1317, the first outlet port 1312 of the outlet tube 1310 is illustratively fluidly coupled to the first solenoid valve 1210*a* through connector tube 1219*b* of the inlet retainer 1214*b*, and the second outlet port 1314 of the outlet tube 1310*a* is illustratively fluidly coupled to a cold water inlet 1318 of the mixing valve 1300 through a conventional fluid line 1319. A hot water source 1320 is fluidly coupled to a hot water inlet 1321 of the mixing valve 1300 through a conventional fluid line 1322.

A first screen filter 1324 is illustratively positioned within the inlet port 1308. A flow regulator or restrictor 1326 is illustratively positioned to regulate water flow through the first outlet port 1312 and sealed by an o-ring 1327. In one illustrative embodiment, the flow restrictor 1326 restricts flow to 0.5 gallons per minute (gpm). A check valve 1328 is positioned within the second outlet port 1314 to prevent backflow of water from the mixing valve 1300 to the second solenoid valve 1210*b* and sealed with o-rings 1330. A second screen filter 1332 is illustratively positioned within the connector tube 1219*a* of the inlet retainer 1214*a*.

An outlet fitting 1334 is fluidly coupled to the outlet passageway 1230 in the solenoid valve body 1202. A fluid delivery device, illustratively a conventional pullout wand 1336 is fluidly coupled to the outlet fitting 1334. O-rings 1338 are illustratively supported by the outlet fitting 1334. A water flow meter 1340, illustratively a flow turbine 1342 rotatably supported by flow meter bearings 1344 supported within the outlet fitting 1334. The flow turbine 1342 measures the water flow rate through the outlet fitting 1334 and is in electrical communication with a sensor 1345 supported on the printed circuit board 1232. The sensor 1345 provides a signal to the controller 1294 indicative of the measured water flow rate. In response, the controller 1294 may control the current supplied to the ozone generator 1100 and the resulting ozone concentration in the water exiting therefrom.

A rivet 1346, illustratively formed of an electrically conductive material (e.g., copper) is supported by the valve body 1202. The rivet 1346 includes a shaft 1348 sealed with an o-ring 1350 and in thermal communication with water flowing through the outlet passageway 1230. A temperature sensor, illustratively a thermistor 1351, is illustratively supported by the printed circuit board 1232 and is in electrical communication with the rivet 1346 (FIG. 18). The thermistor 1351 measures water temperature and provides a signal indicative thereof to the controller 1294. In response, the controller 1294 may control the current supplied to the ozone generator 1100 and the resulting ozone concentration in the water exiting therefrom.

A cover 1352 illustratively supports the solenoid valve body 1202 and the printed circuit board 1232. Illustratively, the fluid connector tubes 1219*a*, 1219*b* of the inlet housings 1214*a*, 1214*b* extend in a first direction (upwardly in FIGS. 16-18), and the outlet fitting 1330 extends in a second direction (downwardly in FIGS. 16-18).

An illustrative operation of the ozone system 1200 is further detailed below in connection with FIGS. 18-24. In the following description, reference to the illustrative operation will be with the ozone system 1200 oriented such that the outlet fitting 1330 extends vertically downwardly and the ozone generator 1100 extends horizontally forwardly. It should be appreciated that orientation of the ozone system 1200 may vary.

The first and second pilot operated diaphragm solenoid valves 1210*a* and 1210*b* are illustratively positioned side by side. The first (or ozone) solenoid valve 1210*a* (illustratively on the right) is used to control the flow of cold water for the ozone generator 1100. The second (or mixed water) solenoid valve 1210*b* (illustratively on the left) controls the flow of mixed water from the faucet mixing valve 1290 for normal operation of the faucet 1000 (for example, through capacitive touch operation of the faucet 1000).

Cold water enters into the wye fitting 1304 through the inlet port 1308 (on the far right in FIG. 17) and passes through screen filter 1324 to remove debris. The cold water splits, either going down through the first outlet port 1312 and to the second solenoid 1210*b* (represented by arrows 1354 in FIG. 19), or up through the second outlet port 1314 and to the cold water inlet for the faucet mixing valve 1300 (represented by arrows 1356 in FIG. 19). The cold water going to mixing valve 1300 passes through check valve 1328 that prevents hot water, which may be at a higher pressure than the cold water, from traveling backwards through faucet mixing valve 1300 and entering the ozone solenoid valve 1210*b*. Before the water enters the ozone solenoid valve 1210*a*, it passes through pressure compensating flow restrictor 1326 that illustratively limits the ozone water flow to 0.5 gpm. This relatively low flow allows the ozone generator 1100 to achieve a desired ozone concertation in the discharged water.

Figure 19A:
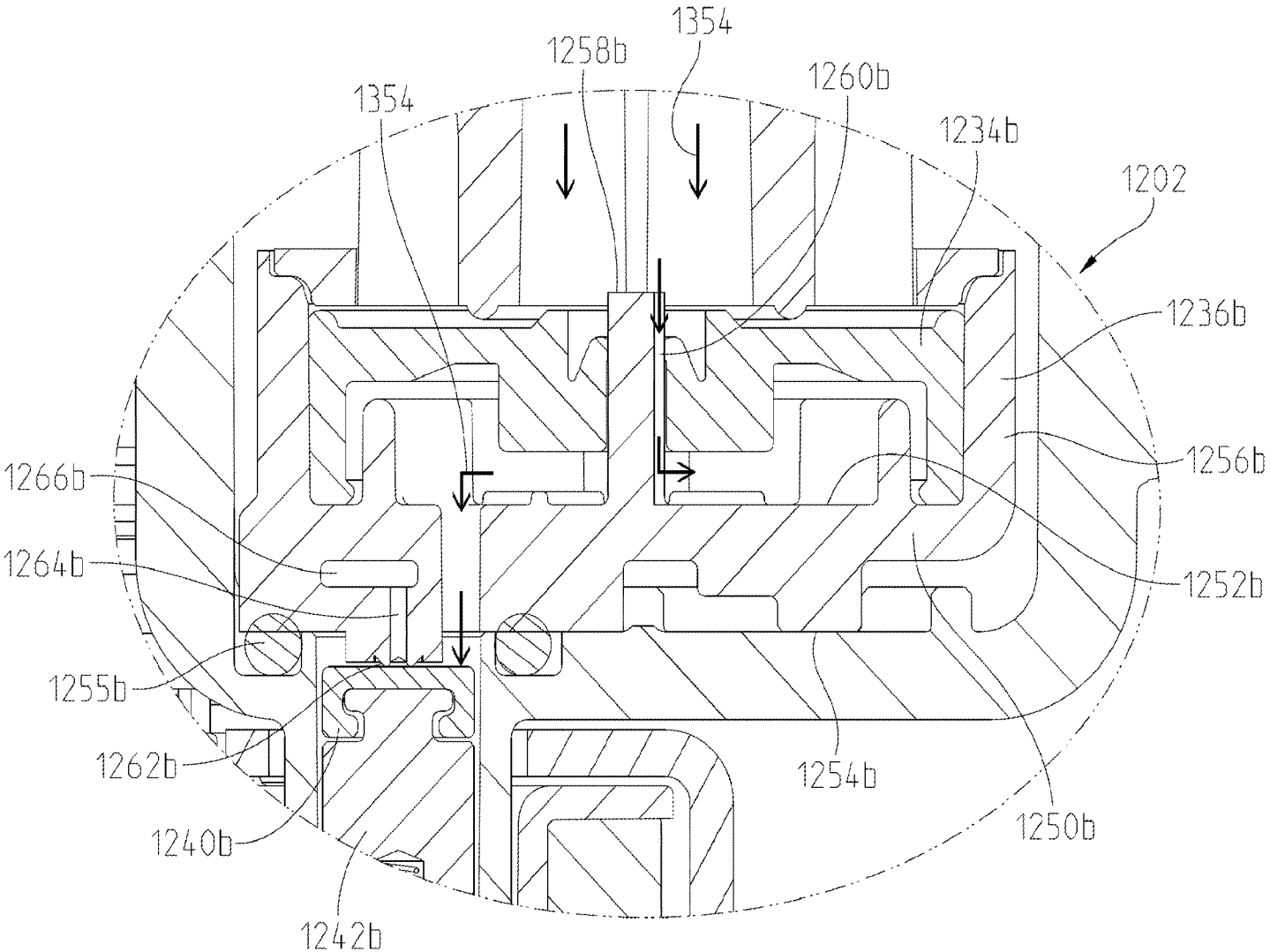
FIG. 19A is detail view of FIG. 19, showing the cold water solenoid valve in a closed position.
Figure 19B:
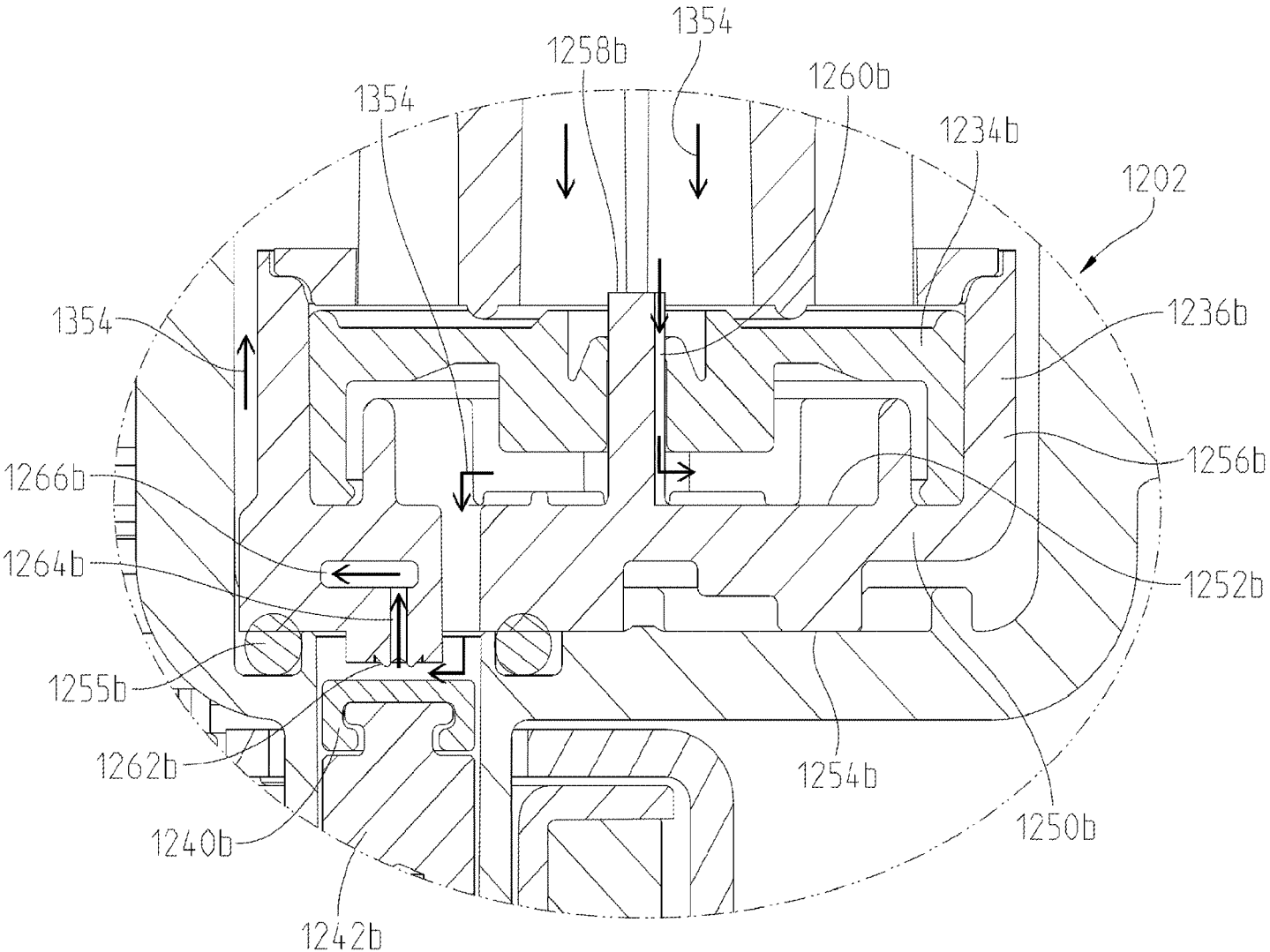
FIG. 19B is a detail view of FIG. 19, showing the cold water solenoid valve in an open position.

FIG. 19A illustrates the second solenoid valve 1210*b* in a closed position, where the seal 1240*b* contacts the valve seat 1262*b* and prevents water flow to the ozone generator 1100. FIG. 19B illustrates the second solenoid valve 1210*b* in an open position, where the seal 1240*b* is spaced apart from the valve seat 1262*b* such that water flows to the ozone generator 1100. More particularly, after the ozone solenoid valve 1210*b* is opened by the coil 1276*b* on the printed circuit board 1232, water flows along slot 1260*b* of post 1258*b*, through an opening 1347 between the seal 1240*b* and the valve seat 1262*b*, out of the ozone solenoid valve 1210*b* via slot 1228*b* in the valve receiving chamber 1212*b*, and then passes around the periphery of the ozone generator 1100 (represented by arrows 1354 in FIGS. 19B-21 and 24). As represented by arrows 1354 in FIG. 24, the water flow through the ozone generator 1100 is parallel to the longitudinal axis L.

After water passes over the diamond electrodes 160, it exits though center opening 1358 of the ozone generator 1100. As may be appreciated, the water flow through the ozone generator 1100 is parallel to the longitudinal axis L.

After exiting the ozone generator 1100, the water path is common for either ozone water flow or normal mixed water flow (where water flow is represented by arrows 1360 in FIGS. 21 and 24).

In the outlet passageway 1230, water then passes by the copper rivet 1346, which is used to transfer heat to the thermistor 1351 mounted on the printed circuit board 1232, which in turn, measures the water temperature. The thermistor 1351 provides a signal indicative of the measured water temperature to the controller. Finally, the water passes through the water flow turbine 1342 which measures the flow rate via sensor 1345 mounted on the printed circuit board 1232 that detects the changing field of the magnetic flow turbine 1342. The sensor 1345 provides a signal indicative of the measured flow rate to the controller 1294. The controller 1294 may vary the power supplied to the ozone generator 1100 based on the temperature and/or flow rate of the water, thereby altering the amount of ozone generated.

Figure 20:
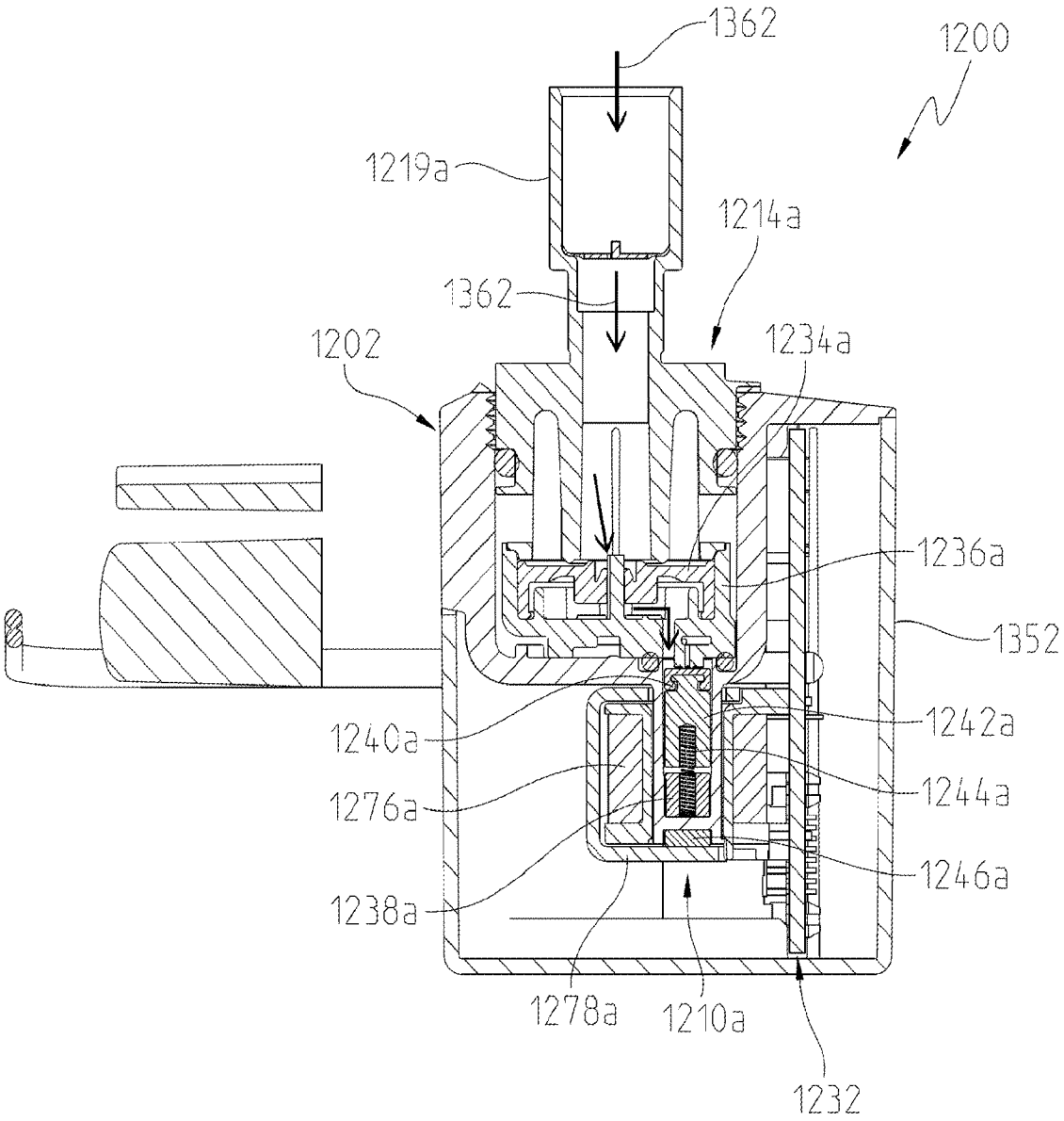
FIG. 20 is a cross-sectional view taken along line 20-20 of FIG. 16.

The hot and cold water from the hot and cold water fluid lines 1319 and 1322 are combined in faucet mixing valve 1300 and enter into the first (left) solenoid valve 1210*a* through the inlet housing 1214*a* (where water flow is represented by arrows 1362 in FIGS. 20, 23 and 24). Screen filter 1332 removes debris. It should be appreciated that operation of the first solenoid valve 1210*a* is similar to the second solenoid valve 1210*b*. More particularly, the first solenoid valve 1210*a* opens and closes via coil 1276*a* on the printed circuit board 1232. The water exits the first solenoid valve 1210*a* via slot 1228*a* in the valve receiving chamber 1212*a* and enters the common outlet passageway 1230 with the ozone water from the ozone generator 1100. The mixed water (from the mixing valve 1300) passes by the same copper rivet 1346 and magnetic flow meter 1340 as the ozone water (from the ozone generator 1100), allowing the measurement of water temperature and flow.

Illustratively, the ozone generator 1100 has current supplied to the diamond electrodes 160 via titanium wire current spreaders 1140. These current spreaders 1140 are illustratively flattened to allow for good contact with the electrode 160. The wire of the current spreaders 1140 transitions to a round section 1142 that allows the use of an o-ring 134 to seal the water inside the ozone generator 1100.

The current spreader 1140 is illustratively connected to the wire harness 1144 via connector 1145 and wire harness plugs into the printed circuit board 1232 via a coaxial power connector. Power is supplied to the printed circuit board 1232 by an AC to DC 24 switching power supply. The 24 volt power is directed through a constant current LED power IC chip. The IC chip holds the current constant as the resistance of the ozone generator 100 changes over the life of the ozone generator 1100. The IC chip also has the ability to increase or decrease the constant current level supplied to the ozone generator 1100 based on the temperature of the water, which affects the amount of ozone that can be generated.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ozone generator system for use with a faucet, the ozone generator system comprising:

a body including an ozone generator receiving chamber and an outlet passageway downstream from the ozone generator receiving chamber;

an ozone generator received within the ozone generator receiving chamber;

wherein the ozone generator comprises an outer cartridge, and an electrolytic cell assembly received within the outer cartridge, the electrolytic cell assembly including:

a first housing, a first current spreader supported by the first housing, an anode in electrical communication with the first current spreader, a second housing, a second current spreader supported by the second housing, a cathode in electrical communication with the second current spreader, and a separator between the anode and the cathode;

a controller operably coupled to the ozone generator;

a water flow meter operably coupled to the controller and in fluid communication with water passing through the outlet passageway to detect a flow rate of water and provide a flow rate signal indicative thereof to the controller;

a temperature sensor operably coupled to the controller and in thermal communication with water passing through the outlet passageway to measure a temperature of water and provide a temperature signal indicative thereof to the controller; and wherein the controller controls the ozone generator in response to the flow rate signal and the temperature signal, thereby altering the amount of ozone generated.

2. The ozone generator system of claim 1, further comprising:

a mixing valve having a cold water inlet fluidly coupled to a cold water source, a hot water inlet fluidly coupled to a hot water source, and an outlet in selective fluid communication with the cold water inlet and the hot water inlet;

wherein the body further includes a first valve receiving chamber and a second valve receiving chamber;

a first electrically operable valve received within the first valve receiving chamber and operably coupled to the controller, wherein the first electrically operable valve is configured to control water flow from the outlet of the mixing valve to the outlet passageway of the body; and a second electrically operable valve received within the second valve receiving chamber and operably coupled to the controller, wherein the second electrically operable valve is configured to control water flow from the cold water source to the ozone generator.

3. The ozone generator system of claim 2, wherein the first electrically operable valve is a first pilot operated diaphragm solenoid valve, and the second electrically operable valve is a second pilot operated diaphragm solenoid valve.

4. The ozone generator system of claim 3, further comprising a printed circuit board supported by the body, wherein the first pilot operated diaphragm solenoid valve includes a first solenoid armature supporting a seal movable by activation of a first solenoid coil coupled to the printed circuit board, and the second pilot operated diaphragm solenoid valve includes a second solenoid armature supporting a seal movable by activation of a second solenoid coil coupled to the printed circuit board.

5. The ozone generator system of claim 1, wherein the controller controlling the ozone generator controls the concentration of ozone in the water in the outlet passageway based on the flow rate signal and the temperature signal.

6. The ozone generator system of claim 1, wherein the water flow meter includes a flow turbine rotatably supported by bearings, and a sensor operably coupled to the flow turbine for generating the flow rate signal.

7. The ozone generator system of claim 1, wherein the temperature sensor comprises a thermistor.

8. The ozone generator system of claim 7, further comprising a printed circuit board supporting the controller and the thermistor.

9. The ozone generator system of claim 8, further comprising a metal rivet supported by the body in thermal communication with the water passing through the outlet passageway and operably coupled to the thermistor.

10. The ozone generator system of claim 1, further comprising a holder that couples the first housing to the second housing independently of the outer cartridge.

11. The ozone generator system of claim 10, wherein the holder comprises at least one sealing ring around the first and second housings.

12. The ozone generator system of claim 1, further comprising an outer pipe fitting snap fit to the outer cartridge.

13. The ozone generator system of claim 12, wherein the outer pipe fitting is internally threaded for coupling with an externally threaded fluid pipe.

14. An ozone generator for use with a faucet, the ozone generator comprising:

an outer cartridge;

an electrolytic cell assembly received within the outer cartridge, the electrolytic cell assembly including:

a first housing;

a first current spreader supported by the first housing;

an anode in electrical communication with the first current spreader;

a second housing;

a second current spreader supported by the second housing;

a cathode in electrical communication with the second current spreader; and a separator between the anode and the cathode; and an outer pipe fitting snap fit to the outer cartridge.

15. The ozone generator of claim 14, wherein the outer pipe fitting is internally threaded for coupling with an externally threaded fluid pipe.

16. The ozone generator of claim 14, wherein the outer cartridge includes a plurality of circumferentially spaced arms snap fit to the outer pipe fitting.

17. The ozone generator of claim 14, further comprising a holder that couples the first housing to the second housing independently of the outer cartridge.

18. The ozone generator of claim 17, wherein the holder comprises at least one sealing ring around the first and second housings.

19. The ozone generator of claim 14, further comprising:

an end cap coupled to the outer cartridge; and wire leads extending through the end cap.

20. An ozone generator for use with a faucet, the ozone generator comprising:

an outer cartridge;

an electrolytic cell assembly received within the outer cartridge, the electrolytic cell assembly including:

a first housing;

a first current spreader supported by the first housing;

an anode in electrical communication with the first current spreader;

a second housing;

a second current spreader supported by the second housing;

a cathode in electrical communication with the second current spreader; and a separator between the anode and the cathode; and an outer pipe fitting coupled to the outer cartridge, wherein the outer pipe fitting is internally threaded for coupling with an externally threaded fluid pipe.

21. The ozone generator of claim 20, further comprising a holder that couples the first housing to the second housing independently of the outer cartridge.

22. The ozone generator of claim 21, wherein the holder comprises at least one sealing ring around the first and second housings.

23. The ozone generator of claim 20, further comprising:

an end cap coupled to the outer cartridge; and wire leads extending through the end cap.

* * * * *